430-581 SR
9/15/86 OR 4,612,278

United States Patent [19]
Lau et al.

[11] Patent Number: 4,612,278
[45] Date of Patent: Sep. 16, 1986

[54] PHOTOGRAPHIC MATERIALS AND PROCESS COMPRISING POLYMERIC COUPLERS WITH ALKOXYALKYLACRYLATE COMONOMERS

[75] Inventors: Philip Lau; Ping W. Tang, both of Rochester, N.Y.

[73] Assignee: Eastman Kodak Company, Rochester, N.Y.

[21] Appl. No.: 756,138

[22] Filed: Jul. 17, 1985

[51] Int. Cl.[4] ..... G03C 1/40; G03C 7/32
[52] U.S. Cl. ..... 430/381; 430/548
[58] Field of Search ..... 430/548, 381

[56] References Cited

U.S. PATENT DOCUMENTS

| | | | |
|---|---|---|---|
| 3,370,952 | 2/1968 | Dawson | 430/548 |
| 3,926,436 | 12/1975 | Monbaliu et al. | 430/548 |
| 4,080,211 | 3/1978 | Paesschen et al. | 430/548 |
| 4,388,404 | 6/1983 | Morigaki et al. | 430/548 |
| 4,411,987 | 10/1983 | Kobayashi et al. | 430/542 |
| 4,474,870 | 10/1984 | Yagihara et al. | 430/548 |

FOREIGN PATENT DOCUMENTS

| | | | |
|---|---|---|---|
| 60-534 | 3/1985 | Japan . | |
| 2132370A | 7/1984 | United Kingdom | 430/548 |

OTHER PUBLICATIONS

*Research Disclosure*, Dec. 1978, Item No. 17643.

*Primary Examiner*—Richard L. Schilling
*Attorney, Agent, or Firm*—Richard E. Knapp

[57] ABSTRACT

Photographic silver halide materials comprise a polymeric coupler which is at least a copolymer having a repeating unit (A) which comprises at least one coupler moiety (COUP) capable of forming a dye upon coupling with an oxidized color developing agent and at least one repeating unit (B) which is derived from a monomer which is an alkoxyalkylacrylate. The polymeric coupler optionally comprises at least one repeating unit (C) derived from such monomers as those useful for repeating unit (A), those useful for repeating unit (B) and other monomers which can be selected to provide useful physical and chemical properties. The photographic material comprising such a polymeric coupler upon exposure and processing enables formation of a dye image having increased dye density.

23 Claims, No Drawings

PHOTOGRAPHIC MATERIALS AND PROCESS COMPRISING POLYMERIC COUPLERS WITH ALKOXYALKYLACRYLATE COMONOMERS

FIELD OF THE INVENTION

The present invention relates to a photographic silver halide material comprising a new polymeric coupler capable of forming a dye image having increased dye density. The invention also relates to a process of forming a dye image in such a photographic silver halide material.

BACKGROUND OF THE INVENTION

Photographic materials comprising polymeric couplers capable of forming a dye image are known. Examples of such photographic materials and polymeric couplers are described in, for example, U.S. Pat. No. 4,388,404 and United Kingdom Patent Specification No. 2,132,370A. These photographic materials comprise polymeric couplers which are copolymers or terpolymers comprise a repeating unit derived from an alkylacrylate. These materials exhibit a problem in that the image dye density resulting from such polymeric couplers is less than desired.

SUMMARY OF THE INVENTION

It has now been found that increased dye density is provided by means of a photographic element comprising at least one photographic silver halide emulsion layer and a polymeric coupler wherein the polymeric coupler comprises at least one repeating unit derived from a monomer which is an alkoxyalkylacrylate. Such a polymeric coupler has at least one repeating unit (A) which comprises at least one coupler moiety capable of forming a dye upon coupling with an oxidized color developing agent and at least one repeating unit (B) which is derived from a monomer (MON-B) which is an alkoxyalkylacrylate. The term alkoxyalkylacrylate herein includes not only alkoxyalkylacrylate but also alkoxyalkylmethacrylate. An example of such an alkoxyalkylacrylate is represented by the formula:

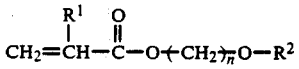

wherein:

$R^1$ is hydrogen, methyl or chlorine;

$R^2$ is alkyl, such as straight chain or branched chain alkyl, for example, alkyl containing 1 to 10 carbon atoms, or $-R^3-O-R^4$;

n is 1 to 10, preferably 1 to 8;

$R^3$ is alkylene, such as alkylene containing 1 to 8 carbon atoms; and, $R^4$ is alkyl, such as straight chain or branched chain alkyl, for example, alkyl containing 1 to 10 carbon atoms.

A dye image can be formed in an exposed photographic silver halide element as described by developing the photographic silver halide element with a color developing agent in a color developer composition. The color developing agent in oxidized form reacts with the polymeric coupler to form a dye image. The dye yield is increased compared to the dye yield from a comparable photographic silver halide element comprising a polymeric coupler comprising a repeating unit derived from an alkylacrylate.

The polymeric couplers of the invention can be used in photographic elements in the same way as polymeric couplers have previously been used in photographic elements.

The described polymeric couplers are prepared by polymerizing by emulsion polymerization, solution polymerization, or other useful method of polymerization at least one monomer (MON-A) comprising a coupler moiety with at least one monomer which is an alkoxyalkylacrylate.

Any monomer (MON-A) is useful which comprises a coupler moiety capable of reacting with oxidized color developing agent and capable of copolymerization with the alkoxyalkylacrylate. These are, for example, monomers (MON-A) represented by the formula:

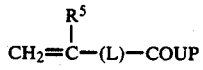

wherein:

$R^5$ is hydrogen, methyl or chlorine;

L is a linking group;

COUP is a coupler moiety capable of reacting with oxidized color developing agent.

The linking group (L) is a chemical bond or a divalent group which connects the coupler moiety (COUP) to the polymer backbone. The linking group (L) can be any divalent group which does not adversely affect the coupling reaction or other desired properties of the polymeric couplers. The linking group (L) can be varied to control such parameters as the rate and time of coupling of the coupler moiety as well as other parameters in the photographic material comprising the polymeric coupler, thus providing more freedom in selecting moieties and groups of the polymeric coupler for a particular end use.

A particularly useful example of a monomer (MON-A) which comprises a coupler moiety is represented by the formula:

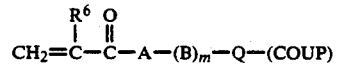

wherein:

$R^6$ is hydrogen, methyl or halogen, particularly chlorine;

A is a divalent atom such as O or NH;

B is alkylene, such as alkylene containing 1 to 4 carbon atoms, for example methylene, ethylene, propylene, butylene; arylene, such as arylene containing 6 to 12 carbon atoms, for example, phenylene and naphthylene; oxydialkylene (-alkylene-O-alkylene-), such as oxydialkylene containing 2 to 8 carbon atoms, for example oxydimethylene, oxydiethylene, oxydipropylene and oxydibutylene; and thiodialkylene (-alkylene-S-alkylene-), such as thiodialkylene containing 2 to 8 carbon atoms, for example, thiodimethylene, thiodiethylene and thiodipropylene;

Q is a divalent linking group, such as —CONH—, —NHCONH— or —COO—;

m is 1 to 10.

Specific examples of useful linking groups (L) are $$-O-\overset{O}{\overset{\|}{C}}-NH-CH_2-CH_2-O-\overset{O}{\overset{\|}{C}}-,$$

$$-NH-\overset{O}{\overset{\|}{C}}-NH-CH_2-CH_2-O-\overset{O}{\overset{\|}{C}}-,$$

$$-NH-\overset{O}{\overset{\|}{C}}-CH_2-NH-\overset{O}{\overset{\|}{C}}-,$$

$$-NH-\overset{O}{\overset{\|}{C}}-CH_2-CH_2-O-\overset{O}{\overset{\|}{C}}-,\ -NH-\overset{O}{\overset{\|}{C}}-O-,$$

$$-NH\overset{O}{\overset{\|}{C}}-\ \text{or}\ -\overset{O}{\overset{\|}{C}}-O-.$$

The polymeric coupler can comprise a combination of linking groups if desired.

Examples of useful monomers (MON-A) containing a coupler moiety are described in, for instance, the following references: U.S. Pat. Nos. 4,411,987; 4,474,870; 4,455,366; 4,455,363; 4,436,808; 4,409,320; 4,444,870; 3,767,412; 3,912,513; 3,926,436; 4,128,427; 4,340,664; 4,367,282; 4,388,404; 3,451,820; 3,444,110; 3,370,952; 3,356,686; and 3,163,625, the disclosures of which are incorporated herein by reference. Addenda which are useful in photographic materials containing polymeric couplers and methods of polymerizing monomers containing a coupler moiety are also described in these references.

Any alkoxyalkylacrylate monomer is useful which is copolymerizable with the monomer (MON-A) comprising a coupler moiety. Examples of useful alkoxyalkylacrylate monomers are:

$$CH_2=CH-\overset{O}{\overset{\|}{C}}-O(CH_2)_2O-C_2H_5$$

$$CH_2=\overset{CH_3}{\overset{|}{C}}-\overset{O}{\overset{\|}{C}}-O(CH_2)_2O-C_2H_5$$

$$CH_2=CH-\overset{O}{\overset{\|}{C}}-O(CH_2)_2O-CH_3$$

$$CH_2=\overset{CH_3}{\overset{|}{C}}-\overset{O}{\overset{\|}{C}}-O(CH_2)_2O-CH_3$$

$$CH_2=CH-\overset{O}{\overset{\|}{C}}-O(CH_2)_3O-C_2H_5$$

$$CH_2=\overset{CH_3}{\overset{|}{C}}-\overset{O}{\overset{\|}{C}}-O(CH_2)_3O-C_2H_5$$

$$CH_2=CH-\overset{O}{\overset{\|}{C}}-O(CH_2)_3O-CH_3$$

$$CH_2=\overset{CH_3}{\overset{|}{C}}-\overset{O}{\overset{\|}{C}}-O(CH_2)_3O-CH_3$$

$$CH_2=CH-\overset{O}{\overset{\|}{C}}-O(CH_2)_2O-CH_2CH_2CH_3$$

$$CH_2=\overset{CH_3}{\overset{|}{C}}-\overset{O}{\overset{\|}{C}}-O(CH_2)_2O-CH_2CH_2CH_3$$

-continued $$CH_2=CH-\overset{O}{\overset{\|}{C}}-O(CH_2)_2O-CH_2CH_2OH$$

$$CH_2=\overset{CH_3}{\overset{|}{C}}-\overset{O}{\overset{\|}{C}}-O(CH_2)_3O-CH_2CH_2OH$$

$$CH_2=CH-\overset{O}{\overset{\|}{C}}-O(CH_2)_2O(CH_2)_mO-CH_3\ \text{and}$$

$$CH_2=\overset{CH_3}{\overset{|}{C}}-\overset{O}{\overset{\|}{C}}-O(CH_2)_2O(CH_2)_mO-CH_3$$

wherein: m is 1 to 8.

These monomers can be prepared by methods known in the organic compound synthesis art. The alkoxyalkylacrylate monomer is a non-dye-forming monomer which, in the form of a repeating unit in the polymeric coupler, does not couple with the oxidation product of a color developing agent. Combinations of two or more different alkoxyalkylacrylate monomers are useful.

A particularly useful polymeric coupler according to the invention is represented by the formula:

$$\left(CH_2-\underset{\substack{|\\(L)\\|\\(COUP)}}{\overset{R^5}{\overset{|}{C}}}\right)_x \qquad \left(CH_2-\underset{\substack{|\\C=O\\|\\O(CH_2)_nO-R^2}}{\overset{R^1}{\overset{|}{C}}}\right)_y$$

wherein:

COUP is a coupler moiety capable of reacting with oxidized color developing agent, preferably a coupler moiety capable of forming a dye, such as a cyan, magenta or yellow image dye, upon reaction with oxidized color developing agent;

$R^1$ and $R^5$ are individually hydrogen, methyl or chlorine;

$R^2$ is alkyl, including straight chain alkyl or branched chain alkyl, such as alkyl containing 1 to 10 carbon atoms, or $-R^3-O-R^4$;

$R^3$ is alkylene, such as alkylene containing 1 to 8 carbon atoms;

$R^4$ is alkyl, including straight chain alkyl or branched chain alkyl, such as alkyl containing 1 to 10 carbon atoms;

x is 1 to 10;

y is 1 to 10;

n is 1 to 10, preferably 1 to 8;

L is a linking group as described.

Another particularly useful polymeric coupler according to the invention is represented by the formula:

$$\left(CH_2-\underset{\substack{|\\A\\|\\(B)_m-Q-(COUP)}}{\overset{R^6}{\overset{|}{C}}}\right)_x \qquad \left(CH_2-\underset{\substack{|\\C=O\\|\\O(CH_2)_nO-R^2}}{\overset{R^1}{\overset{|}{C}}}\right)_y$$

wherein: $R^6$, A, B, m, Q, COUP, $R^1$, y, n and $R^2$ are as described.

One or more added comonomers (MON-C) are also useful in preparing polymeric couplers. The comonomers can be the same or different from described monomers MON-A and MON-B. The added comonomers are ethylenically unsaturated and capable of copolymerizing with the monomer (MON-A) containing a coupler moiety and the alkoxyalkylacrylate monomer. The added comonomers are selected to provide useful physical and chemical properties for the polymeric coupler, such as useful solubility, compatability with the components of the photographic materials, stability and flexibility.

The added comonomers (MON-C) can, for example, contain a coupler moiety, such as a cyan dye-forming, magenta dye-forming, yellow dye-forming moiety, or a competing coupler moiety. The coupler moiety in MON-C can be, for example, the same or different from the coupler moiety in MON-A. Added examples of MON-C are as follows:

acrylic acid;
methacrylic acid;
acylic acid esters, such as methyl acrylate, β-hydroxyethylacrylate, β-carboethylacrylate and its metallic salts, β-sulfoethylacrylate and its metallic salts, methyl methacrylate, ethyl acrylate, n-butyl acrylate, t-butyl acrylate, and 2-ethylhexyl acrylate;
acrylic acid amides, such as acrylamide, methacrylamide and mono or disubstituted acrylamide and methacrylamide, such as 2-acrylamido-2-methyl propane sulfonic acid;
vinyl esters, such as vinyl acetate, vinyl propionate, and vinyl laurate;
acrylonitrile;
methacrylonitrile;
aromatic vinyl compounds, such as styrene, vinyl toluene, and vinyl acetophenone;
vinylidene chloride;
itaconic acid and itaconic acid monoesters, such as methyl, ethyl, propyl and butyl monoesters;
citraconic acid;
crotonic acid;
maleic acid esters, such as methyl, ethyl, butyl, and aryl esters, such as phenyl esters;
N-vinyl-2-pyrrolidone;
N-vinyl pyridine;
vinyl alkyl ethers, such as methyl, ethyl, butyl, and aryl esters, such as phenyl esters.

The term alkyl herein includes unsubstituted alkyl, including straight chain alkyl or branched chain alkyl. The term alkyl herein also includes optionally substituted alkyl wherein alkyl contains substituents which do not adversely affect the useful properties of the described polymeric couplers or the photographic materials incorporating the polymeric couplers. The term aryl herein includes unsubstituted aryl, such as unsubstituted phenyl. The term aryl herein also includes optionally substituted aryl, such as substituted phenyl, whrein the aryl includes at least one substituent which does not adversely affect the useful properties of the described polymeric couplers or the photographic materials containing the polymeric couplers. When two or more substituents are present on the alkyl or aryl, the substituents can be the same or different.

Examples of new polymeric couplers are as follows:

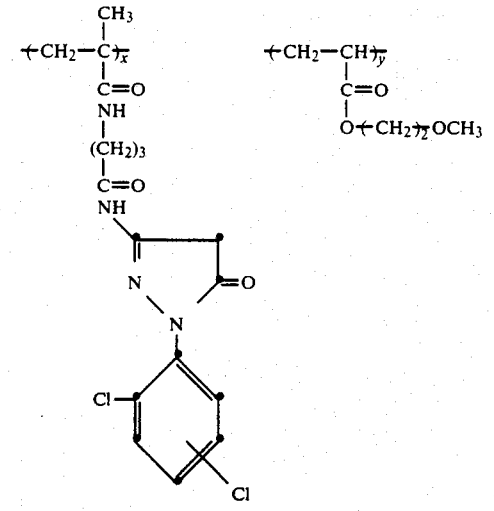
(1)

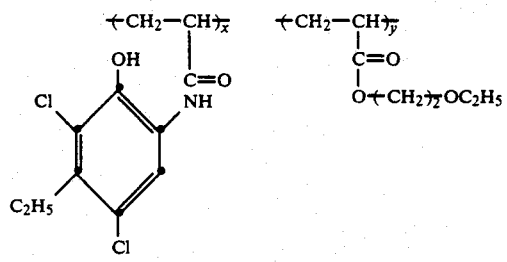
(2)

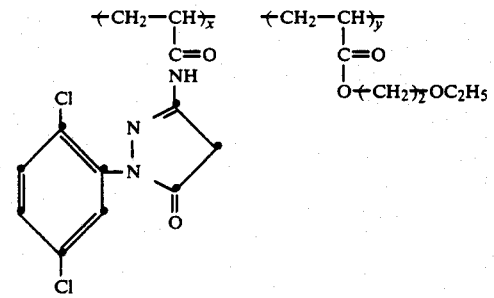
(3)

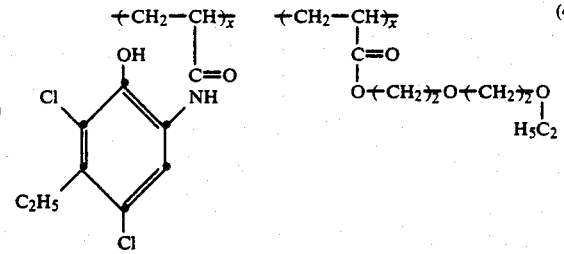
(4)

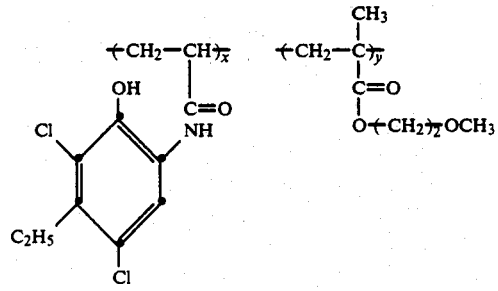
(5)

-continued
(6)
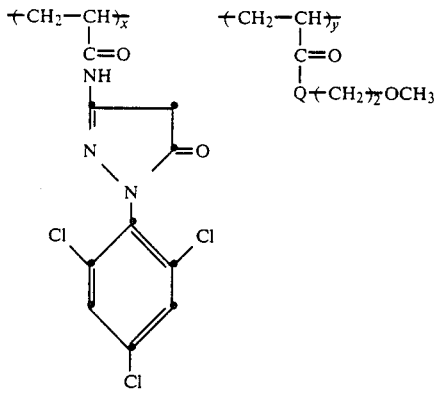
(7)
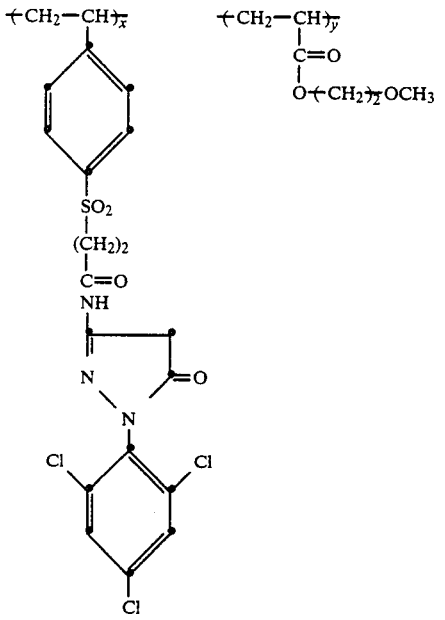
(8)
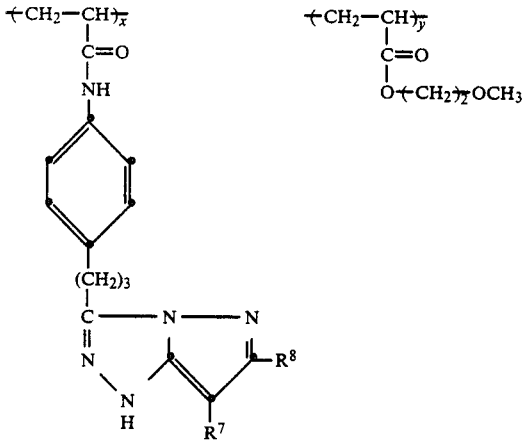
$R^7$ is Cl, OAr, OAlkyl or SAlkyl;
$R^8$ is $CH_3$, ter-butyl or Ar.
Ar herein represents aryl, such as phenyl or substituted phenyl.
(9)
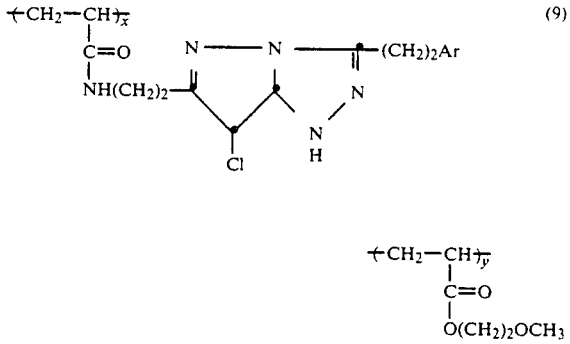
(10)
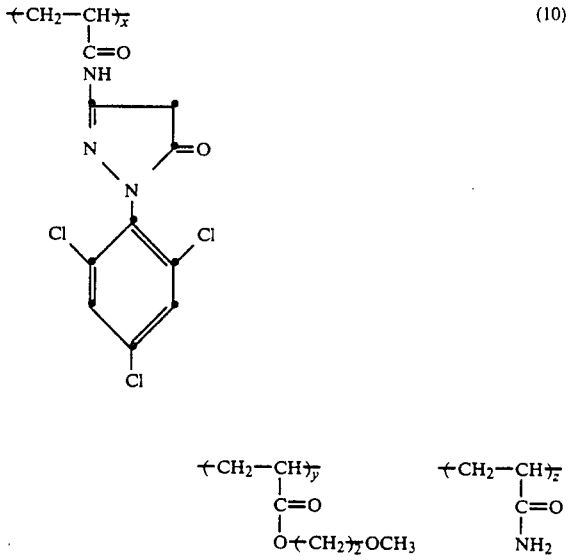
(11)
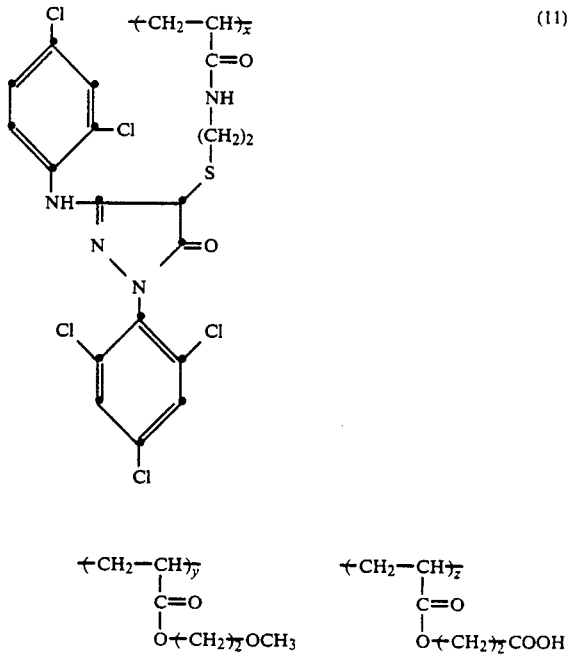

-continued
(12)
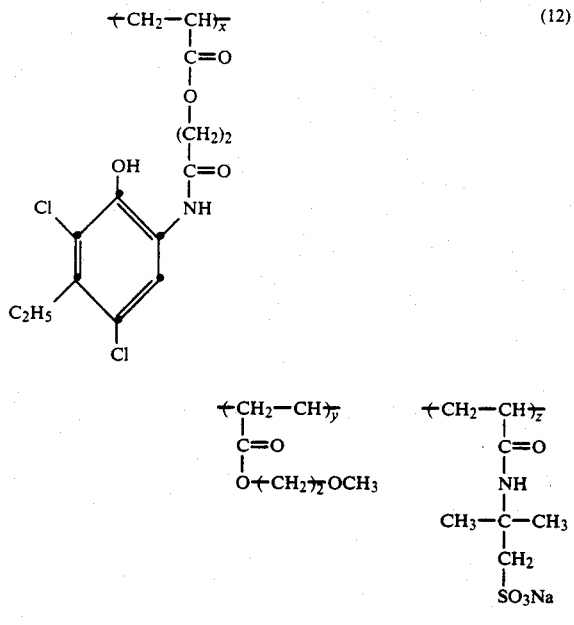
(13)
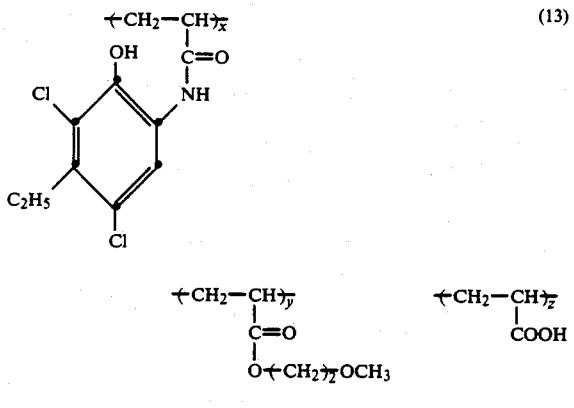
(14)
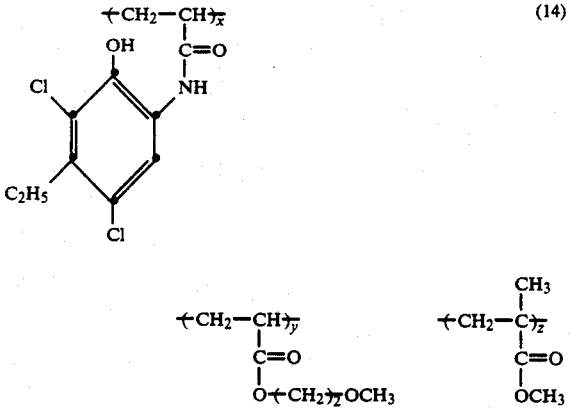
(15)
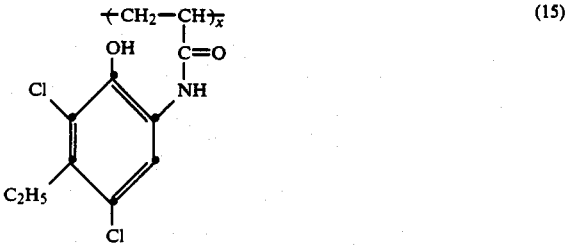
-continued
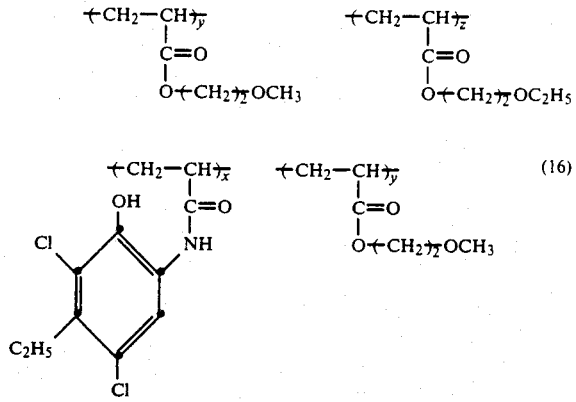
(16)
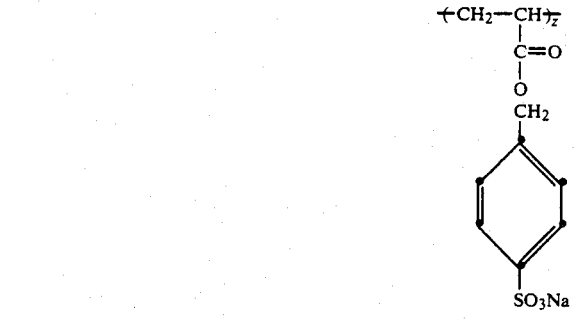
(17)
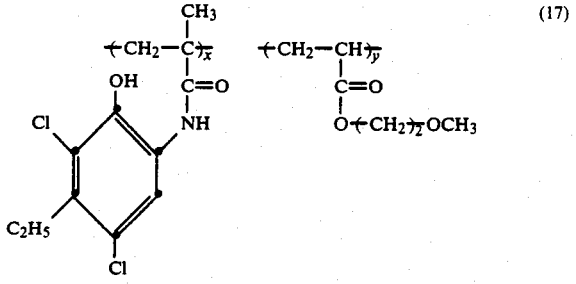
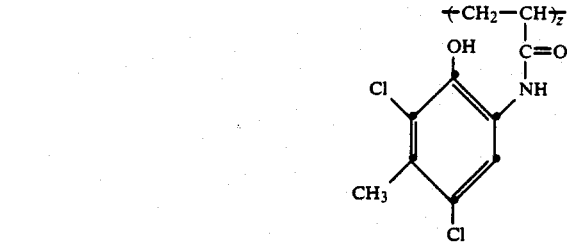
(18)
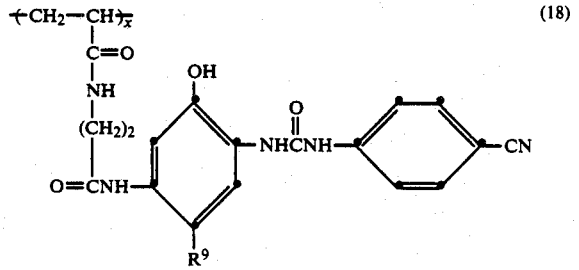

-continued
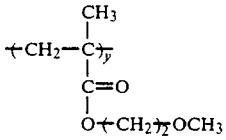
$R^9$ herein is hydrogen, aryloxy, such as phenoxy, or alkoxy, such as alkoxy containing 1 to 10 carbon atoms, for example methoxy, butoxy and decyloxy.
(19)
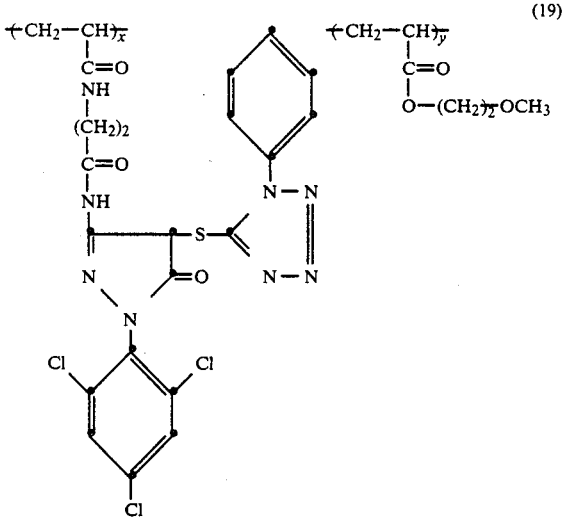
(20)
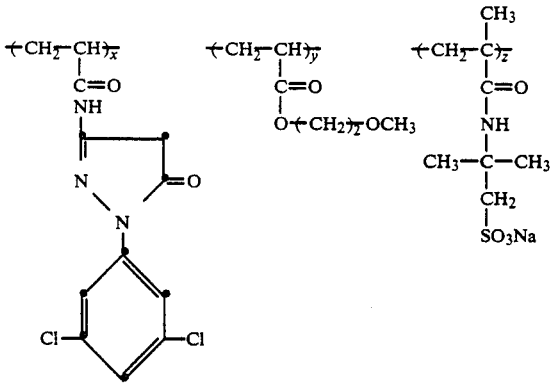
-continued
(21)
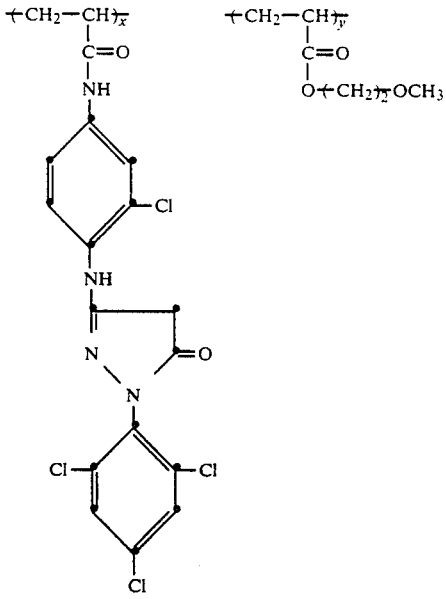
(22)
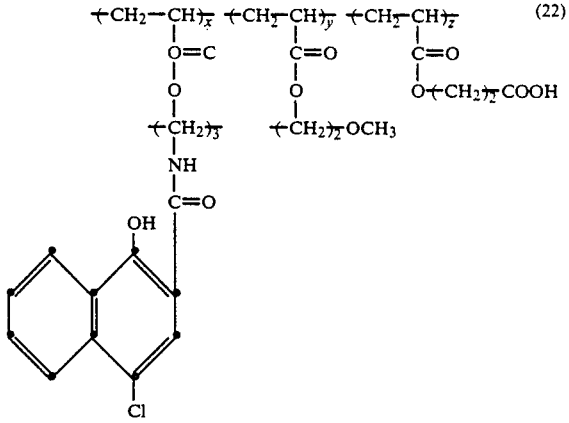
(23)
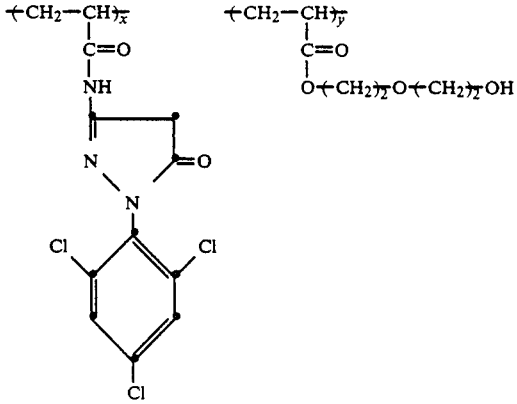

-continued
(24)
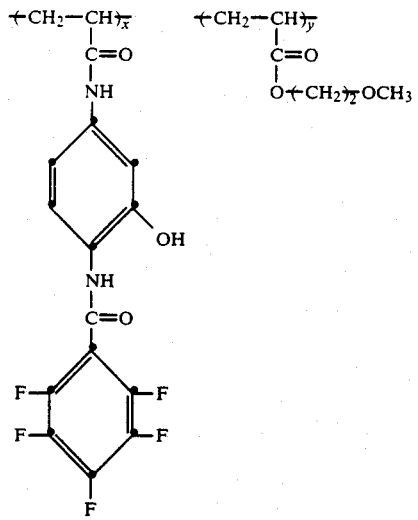
(25)
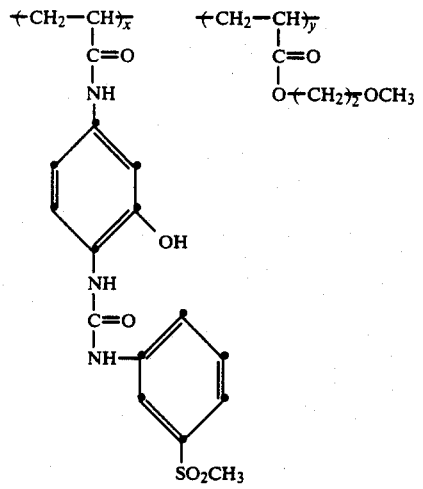
(26)
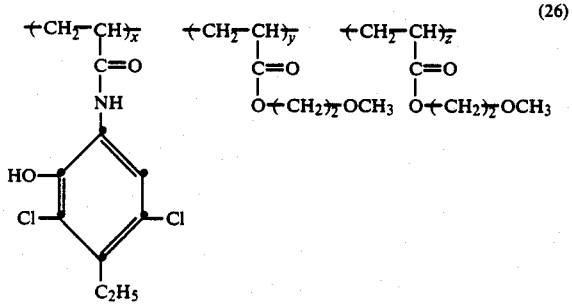
-continued
(27)
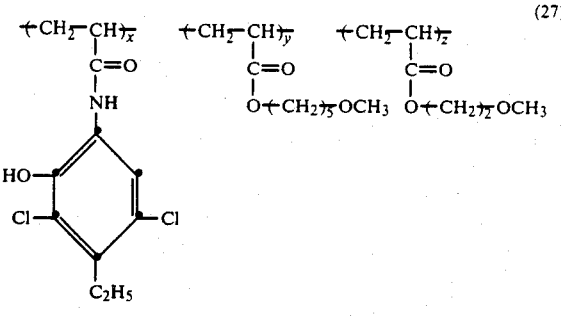
(28)
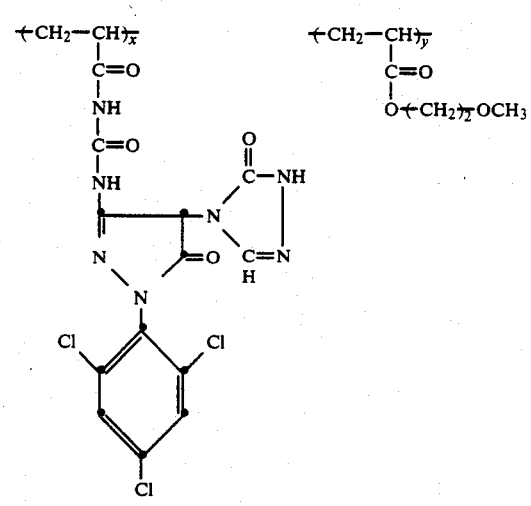
(29)
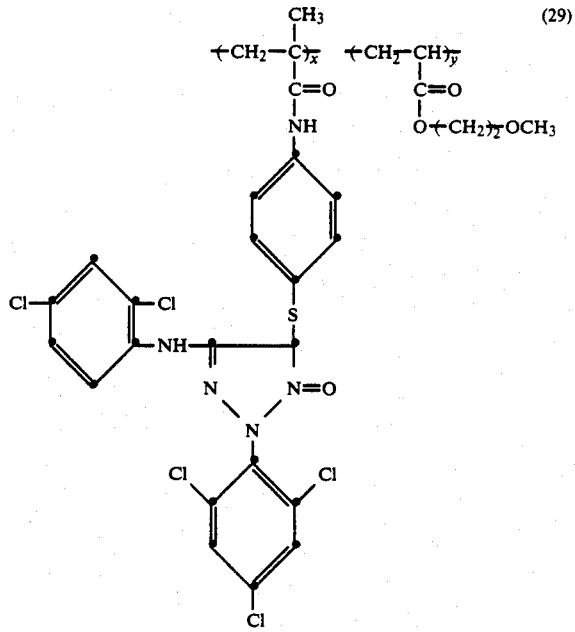

-continued
(30)
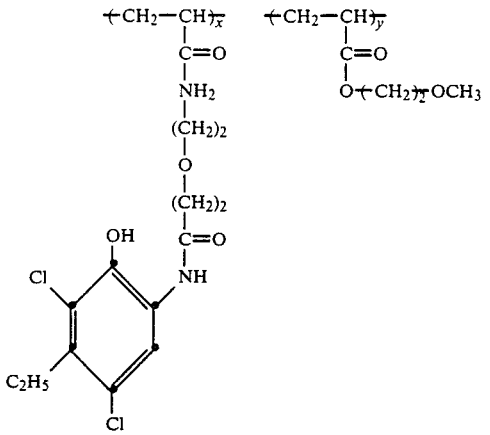
(31)
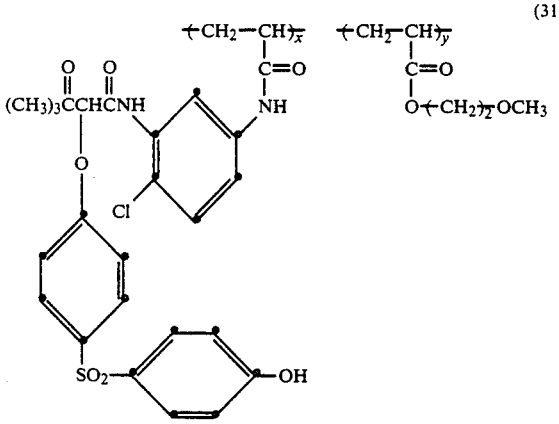
(32)
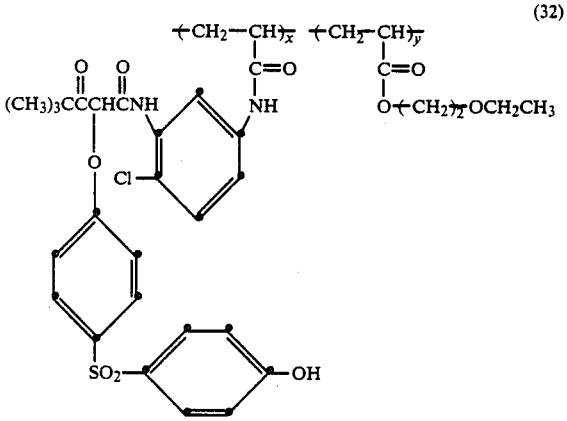
-continued
(33)
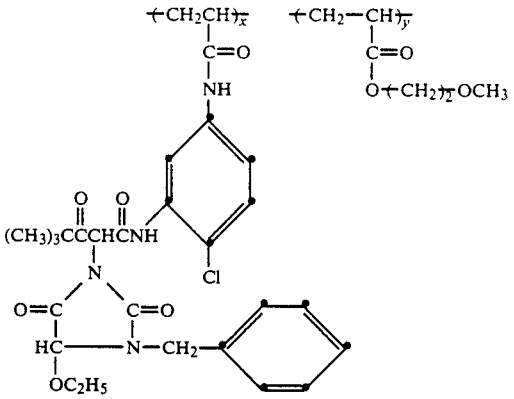
(34)
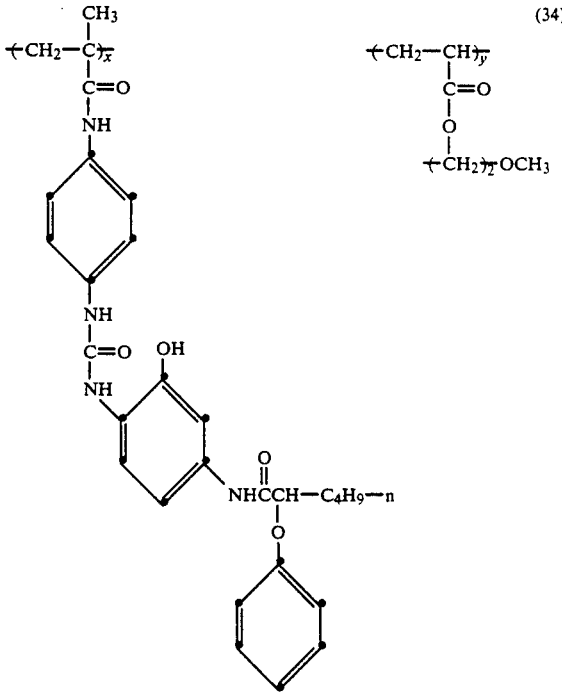

-continued (35)

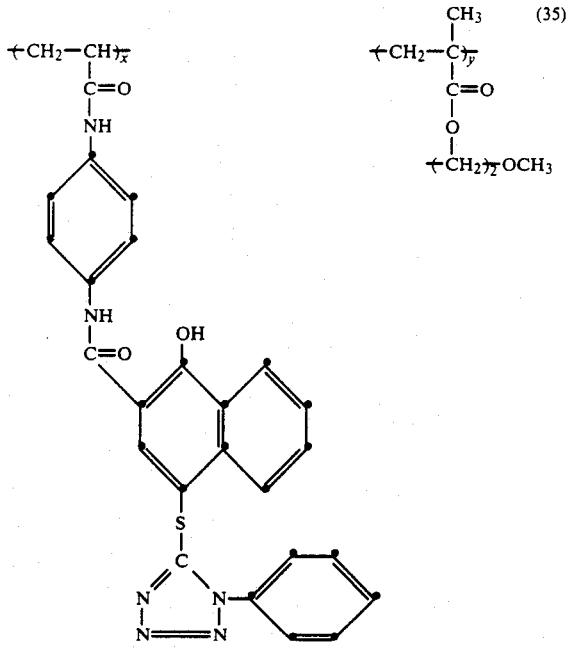

(36)

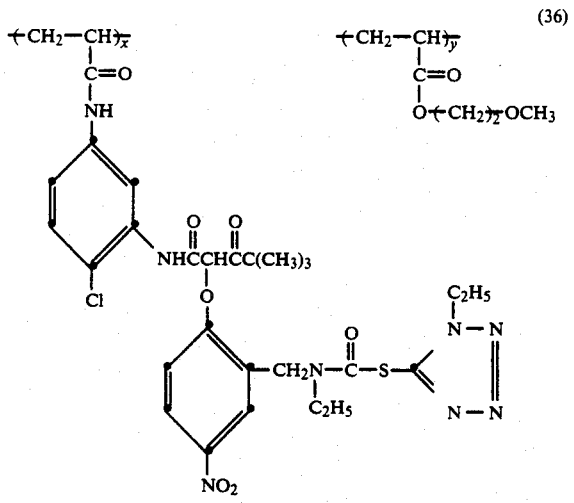

(37)

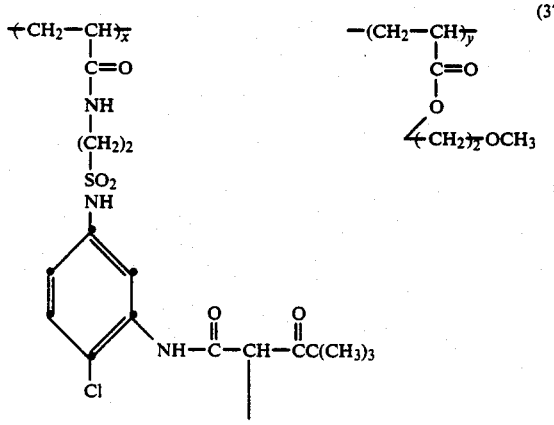

-continued

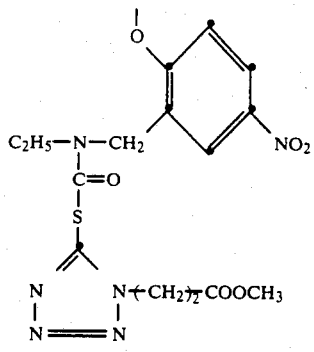

(38)

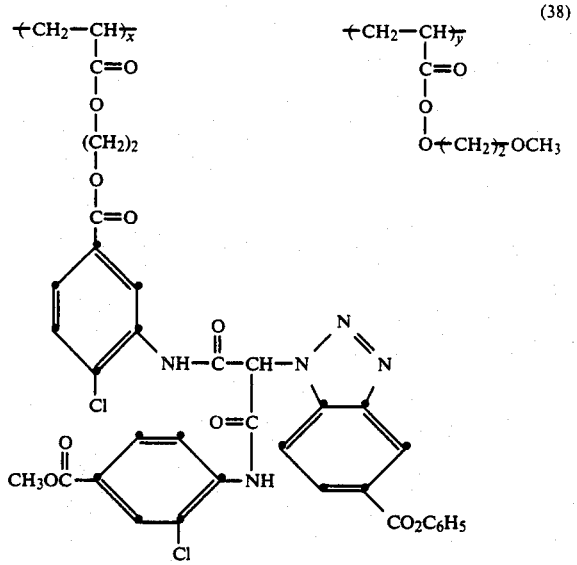

Herein x is 1 to 10; y is 1 to 10; and z is 1 to 10.

Any organic solvent is useful in preparing the polymeric coupler in latex form in an aqueous gelatin solution as long as the organic solvent can be removed in preparing a photographic material. Examples of organic solvents which are useful in preparing the polymeric coupler in latex form are: methyl ester solvents, methyl ethyl ketone (MEK), ethylene glycol dimethyl ether, tetraethylene glycol dimethyl ether, dioxane, chlorinated hydrocarbon solvents, such as methylene chloride and trichloroethylene, alcohols, such as n-butyl alcohol and octyl alcohol and mixtures of such solvents.

In preparing compositions of the polymeric couplers for use in photographic materials, stability of the dispersion and other useful properties are generally improved by incorporating a water-immiscible high-boiling (above about 200° C.) organic solvent in the composition containing the polymeric coupler. Examples of useful high-boiling organic solvents are coupler solvents known in the photographic art, such as di-n-butylphthalate, tricresyl phosphate, diethyl lauramide, and tris-2-ethylhexyl phosphate. The concentration of high-boiling organic solvent is typically within the range of 1 to 50% by weight based on the polymeric coupler. The concentration of high-boiling solvent is at a level which helps plasticize the polymeric coupler while the polymeric coupler is maintained in solid particle form. Combinations of water-immiscible high boiling organic solvents are also useful.

The polymeric couplers in photographic materials according to the invention are useful with addenda which are known to be advantageous in photographic materials containing polymeric couplers. Such addenda include, for example, those described in U.S. Pat. Nos. 4,416,978; 4,411,987; 4,388,404; and 4,123,281. Addenda known to be useful in photographic silver halide materials are also useful in photographic silver halide materials according to the invention. Such addenda are described in, for example, *Research Disclosure,* December 1978, Item No. 17643, published by Kenneth Mason Publications, Ltd., The Old Harbourmaster's, 8 North Street, Emsworth, Hampshire P0107DD, England. Such addenda include, for example, chemical sensitizers, spectral sensitizers, brighteners, antifoggants, silver halide emulsion stabilizers and dye stabilizers, light absorbing addenda such as ultraviolet light absorbers, light scattering materials, vehicles and vehicle extenders, hardeners, coating aids, plasticizers, lubricants, antistatic agents, matting agents, developing agents, development modifiers, scavengers for developer oxidation products, and combinations of such addenda.

The polymeric couplers are preferably prepared in the form of a latex. The polymeric couplers are prepared, for example, by emulsion polymerization or by dissolving an oleophilic polymeric coupler, as described, obtained by copolymerization of monomer (MON-A) with the alkoxyalkylacrylate monomer in an organic solvent and then dispersing the solution in latex form in an aqueous gelatin solution. Emulsion polymerization methods described in, for example, U.S. Pat. Nos. 4,080,211 and 3,370,952 are useful regarding dispersing an oleophilic polymeric coupler, as described, in latex form in an aqueous gelatin solution. The alkoxyalkylacrylate monomer and/or any added monomers can be in liquid form which can act, in the case of emulsion polymerization, as a solvent for one or more of the reactants.

Any emulsifier is useful in an emulsion polymerization process which is compatible with monomer (MON-A) and the comonomer (MON-B) and, if present, other comonomers. Useful emulsifiers are described in, for example, Belgische Chemische Industrie, Vol. 28, pages 16–20 (1963). Examples of useful emulsifiers are surfactants, such as cationic, anionic surfactants, amphoteric surfactants, and other emulsifiers known to be useful for emulsion polymerization processes.

Representative examples of emulsion polymerization processes for preparing the polymeric couplers according to the invention are given in following Synthesis Examples A–C.

The polymeric couplers can also be prepared by a free radical polymerization method. In this method copolymerization of the monomer (MON-A) with the alkoxyalkylacrylate monomer is initiated by the addition of a free radical which is formed by decomposition of a chemical initiator, by redox initiator, or by, for example, irradiation by ultraviolet light or other radiation source which initiates formation of free radicals, or by an anionic or cationic initiator.

The polymeric couplers can also be prepared by a solution polymerization method. This method comprises polymerization of the described monomers in solution in a useful solvent, such as tetrahydrofuran (THF) or chlorinated hydrocarbon solvents, for example, trichloroethylene. A representative example of preparation of a polymerioc coupler by solution polymerization is given in following Synthesis Example F.

The polymeric couplers in photographic materials according to the invention are useful in combination with other couplers, such as monomeric and/or polymeric couplers known in the photographic art, such as described in the following: U.S. Pat. Nos. 4,411,987; 2,367,036; 3,163,625; 4,388,404; 4,474,870; 3,451,820; 4,455,366; 4,455,363; 4,436,808; 4,409,320; 4,444,870; 3,767,412; 3,912,513; 3,926,436; 4,128,427; 4,340,664; 4,367,282; 3,451,820; 3,444,110; 3,370,952; 3,356,686; 3,163,625; and *Research Disclosure,* December, 1978, Item No. 17643, the disclosures of which are incorporated herein by reference.

A dispersion can be prepared by dispersing a hydrophobic polymeric coupler according to the invention, for example, a cyan dye-forming, magenta dye-forming or yellow dye-forming coupler, in a hydrophilic colloid, such as gelatin, by processes known in the photographic art. A latex loading process can be useful. For example, the hydrophobic polymeric coupler can be loaded into a polymeric latex. Alternatively, the hydrophobic polymeric coupler can be loaded into a polymeric coupler latex. Loading processes and techniques are useful which are known in the photographic art.

An illustrative embodiment of the invention is a photographic silver halide material comprising a dispersion which is prepared by dispersing a development inhibitor releasing (DIR) coupler in a hydrophilic colloid which is loaded into a polymeric coupler latex prepared according to the invention. Other processes are also useful for preparing a combination of a DIR coupler with a polymeric coupler in a photographic material according to the invention. The DIR coupler can be a monomeric, dimeric, or polymeric coupler including, for example, a DIR oligomeric coupler.

The polymeric couplers in photographic materials according to the invention are useful in combination with colored monomeric or colored polymeric couplers. Any of such colored couplers known in the photographic art are useful.

The polymeric couplers in photographic materials according to the invention are also useful in combination with competing couplers and/or stain preventing agents, and/or dye image stabilizing agents known in the photographic art.

As used herein, the terms "polymeric coupler" and "polymeric coupler compound" refer to the entire compound, including the coupler moiety and any other groups, such as timing groups, that are present. The term "coupler moiety" refers to that portion of the compound other than timing groups, copolymerized units, and the remainder of the polymer.

In another embodiment the polymeric coupler can comprise a timing group to help control various parameters in imaging. In the case of a timing group in the monomer (MON-A), the timing group and the substituents on it, can be varied to control such parameters as the rate and time of cleavage of the timing group from the coupler moiety and of any other group from the timing group. Since these parameters can be controlled by modification of the timing group, they need not be emphasized in selecting the particular coupler moiety and other particular groups on the timing group, thus providing freedom in selecting such moieties and groups for a particular end use. Examples of timing groups which can be attached to the coupler moiety are as follows:

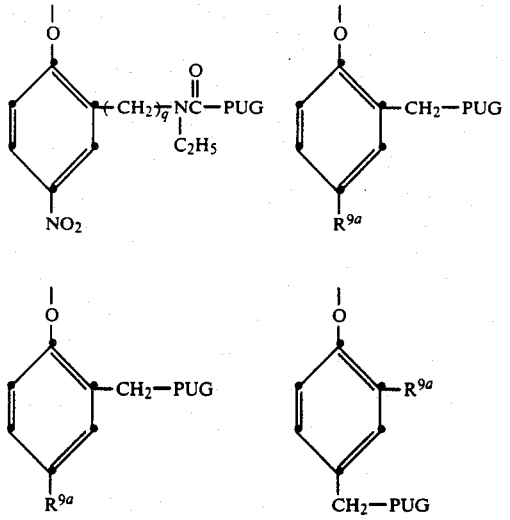

wherein:

q is 0 or 1;

$R^{9a}$ is Cl, $SO_2CH_3$, $CO_2CH_3$, $NO_2$ or $SO_2NHCH_3$; and

PUG is a photographically useful group, such as described in U.S. Pat. No. 4,248,962.

Accordingly, monomer (MON-A) comprising a coupler moiety can contain a timing group between the coupler moiety and a photographically useful group, the coupler moiety being joined to the timing group and the timing group being joined to a photographically useful group so that, upon reaction of the coupler with oxidized color developing agent, the timing group and the photographically useful group are released from the coupler moiety and thereafter the photographically useful group is released from the timing group. The release reaction can be, for example, an intramolecular nucleophilic reaction, such as described in U.S. Pat. No. 4,248,962, or, for example, a quinone-methide type reaction, such as described in U.S. Pat. No. 4,409,323.

There follows a listing of patents and publications which describe representative COUP groups useful in polymeric couplers of the invention. In the following structures the linking group (L), if present, is attached to the polymer backbone. In the following structures X at the coupling position in each of COUP is hydrogen or a coupling-off group known in the photographic art.

I. COUP's

A. Coupler moieties which form cyan dyes upon reaction with oxidized color developing agents are described in such representative patents and publications as: U.S. Pat. Nos. 2,722,162; 2,895,826; 3,002,836; 3,034,892; 2,474,293; 2,423,730; 2,367,531; 3,041,236; and "Farbkupplereine Literaturübersicht," published in Agfa Mitteilungen, Bank II, pp. 156–175 (1961).

Preferably such coupler moieties are phenols and naphthols which form cyan dyes on reaction with oxidized color developing agent. Structures of preferred such coupler moieties are:

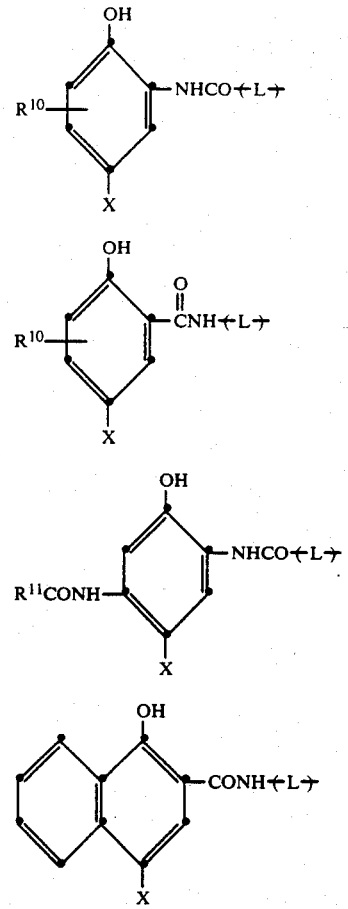

wherein:

L is as defined above; and

X is hydrogen or a coupling-off group known in the photographic art;

$R^{10}$ represents one or more halogen, such as chloro and fluoro, lower alkyl, such as methyl, ethyl and butyl or lower alkoxy, such as methoxy, ethoxy and butoxy groups; and $R^{11}$ represents alkyl containing 1 to 4 carbon atoms, such as methyl, ethyl, butyl, t-butyl or aryl; such as phenyl or substituted phenyl.

The coupling-off group represented by X can be any of the coupling-off groups known in the photographic art. Such coupling-off groups can alter the equivalency of the coupler, can modify the reactivity of the coupler, or can advantageously affect the layer in which the coupler is coated or other layers in the photographic element. Representative coupling-off groups include, for example halogen, alkoxy, alkylthio, arylthio, heterocyclythio, sulfonamido, acyloxy and acyl.

B. Coupler moieties which form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573; and "Farbkupplereine Literaturübersicht," published in Agfa Mitteilungen, Bank II, pp. 126–156 (1961).

Preferably such coupler moieties are pyrazolones and pyrazolotriazoles which form magenta dyes upon reaction with oxidized color developing agents. Structures of preferred such coupler moieties are:

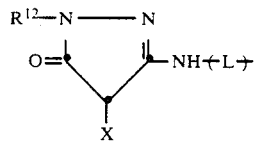

IB-1

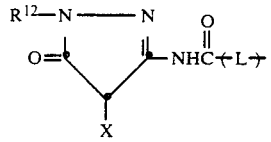

IB-2

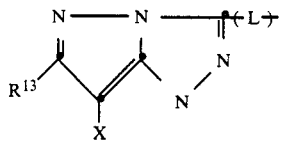

IB-3 wherein:

L and X are as defined above;

$R^{12}$ is aryl or substituted aryl, such as 2,4-, 2,5-, 3,5-dichlorophenyl and 2,4,6-trihalophenyl; and $R^{13}$ is methyl, t-butyl, or aryl.

C. Coupler moieties which form yellow dyes upon reaction with oxidized color developing agent are described in such representative patents and publications as: U.S. Pat. Nos. 2,875,057; 2,407,210; 3,265,506; 2,298,443; 3,048,194; 3,447,928; and "Farbkuppler-eine Literaturübersicht," published in Agfa Mitteilungen, Bank II, pp. 112–126 (1961).

Preferably such yellow dye-forming coupler moieties are acylacetamides, such as benzolyacetanilides and pivalylacetanilides.

Structures of preferred such coupler moieties are:

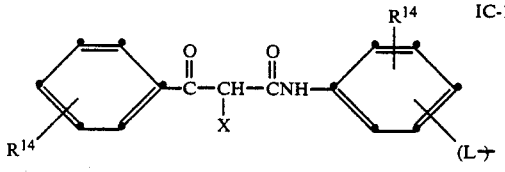

IC-1

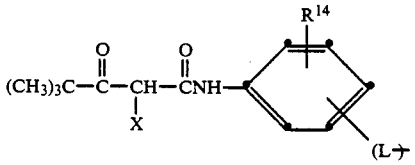

IC-2 wherein:

L and X are as defined above; and $R^{14}$ is hydrogen or one or more halogen, lower alkyl, such as methyl and ethyl or alkoxy of 1 to 10 carbon atoms, or alkyl sulfonyl of 1 to 10 carbon atoms.

D. Coupler moieties which form colorless products upon reaction with oxidized color developing agent are described in such representative patents as: U.K. Pat. No. 861,138; U.S. Pat. Nos. 3,632,345; 3,928,041; 3,958,993; and 3,961,959. Preferably such coupler moieties are cyclic carbonyl containing compounds which form colorless products on reaction with oxidized color developing agent.

Structures of preferred such coupler moieties are:

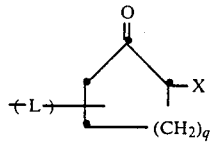

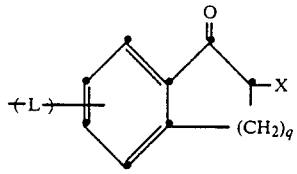

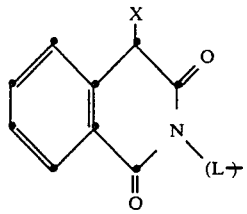

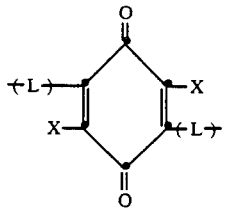

wherein:

L and X are as defined above;

q is 1 or 2.

E. Couplers which form black dyes upon reaction with oxidized color developing agent are described in such representative patents and publications as: U.S. Pat. Nos. 1,939,231; 2,181,944; 2,333,106; 4,126,461; German OLS Nos. 2,644,194; and 2,650,764.

Preferably such coupler moieties are resorcinols or m-aminophenols which form black or neutral products on reaction with oxidized color developing agent.

Structures of preferred such coupler moieties are:

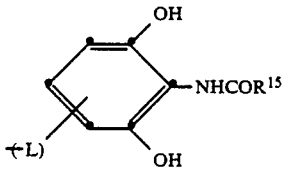

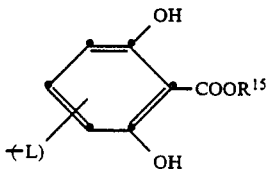

-continued

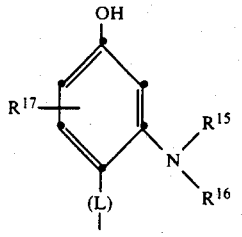

wherein:

L is as defined above;

$R^{15}$ is alkyl of 3 to 20 carbon atoms, phenyl or phenyl substituted with hydroxy, halo, amino, alkyl of 1 to 20 carbon atoms or alkoxy of 1 to 20 carbon atoms;

$R^{16}$ is independently hydrogen, halogen, alkyl of 1 to 20 carbon atoms, alkenyl of 1 to 20 carbon atoms, or aryl of 6 to 20 carbon atoms; and $R^{17}$ is one or more halogen, alkyl of 1 to 20 carbon atoms, alkoxy of 1 to 20 carbon atoms or other monovalent organic groups.

The polymeric couplers according to the invention, and/or other couplers, can be incorporated in photographic processing compositions, such as developer compositions, so that upon development of an exposed photographic element they will be in reactive association with oxidized color developing agent. Coupler compounds incorporated in photographic processing solutions should be of such molecular size and configuration that they will diffuse through photographic layers with the processing solution. When incorporated in a photographic element, as a general rule, the coupler compounds should be nondiffusible, i.e. they should be of such molecular size and configuration that they will not significantly diffuse or wander from the layer in which they are coated.

Photographic elements of this invention can be processed by conventional techniques in which color forming couplers and color developing agents are incorporated in separate processing solutions or compositions and/or in the element.

Photographic elements in which the polymeric couplers of this invention are incorporated can be a simple element comprising a support and a single silver halide emulsion layer or they can be multilayer, multicolor elements. The polymeric couplers of this invention can be incorporated in the silver halide emulsion layer or in another layer, such as an adjacent layer, where they will come into reactive association with oxidized color developing agent which has developed silver halide in the emulsion layer. The silver halide emulsion layer can contain, or have associated with it, other photographic coupler compounds, such as color forming couplers, colored masking couplers, competing couplers and the like. These other photographic coupler compounds can form dyes of the same or different color and hue as the photographic coupler compounds of this invention. Additionally, the silver halide emulsion layer can contain addenda conventionally contained in such layers.

A typical multilayer, multicolor photographic element according to this invention can comprise a support having thereon a red-sensitive silver halide emulsion unit having associated therewith a cyan dye image providing material, a green-sensitive silver halide emulsion unit having associated therewith a magenta dye image providing material and a blue-sensitive silver halide emulsion unit having associated therewith a yellow dye image providing material, at least one of the silver halide emulsion units having associated therewith a polymeric coupler of the invention. Each silver halide emulsion unit can be composed of one or more layers and the various units and layers can be arranged in different locations with respect to one another. The polymeric couplers of this invention can be incorporated in or associated with one or more layers or units of the element.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the silver halide grains. They can be chemically and spectrally sensitized. The emulsions typically will be gelatin emulsions although other hydrophilic colloids can be used in accordance with usual practice. Particularly useful photographic silver halides are tabular grain photographic silver halides, such as described in *Research Disclosure*, January 1983, Item No. 22534 and U.S. Pat. No. 4,434,226.

The support can be any support used with photographic elements. Typical supports include cellulose nitrate film, cellulose acetate film, polyvinylacetal film, polyethylene terephthalate film, polycarbonate film and related films or resinous materials as well as glass, paper, metal and the like. Typically, a flexible support is employed, such as a polymeric film or paper support. Paper supports can be acetylated or coated with baryta and/or an α-olefin polymer, particularly a polymer of an α-olefin containing 2 to 10 carbon atoms such as polyethylene, polypropylene, ethylene-butene copolymers and the like.

The optimum concentration of polymeric coupler in a photographic element according to the invention will depend upon such factors as the desired image, particular processing conditions, particular processing compositions, the particular polymeric coupler, location of the polymeric coupler in the photographic element, and the like. For example, the polymeric coupler is useful within the range of $10^{-4}$ to $10^{-1}$ mole of polymeric coupler per mole of silver in the photographic element, such as within the range of $10^{-3}$ to $10^{-1}$ mole of polymeric coupler per mole of silver in the photographic element.

Illustrative methods of synthesis of polymeric couplers according to the invention are as follows:

SYNTHESIS EXAMPLE A

This illustrates the synthesis of a cyan dye-forming phenolic coupler as follows:

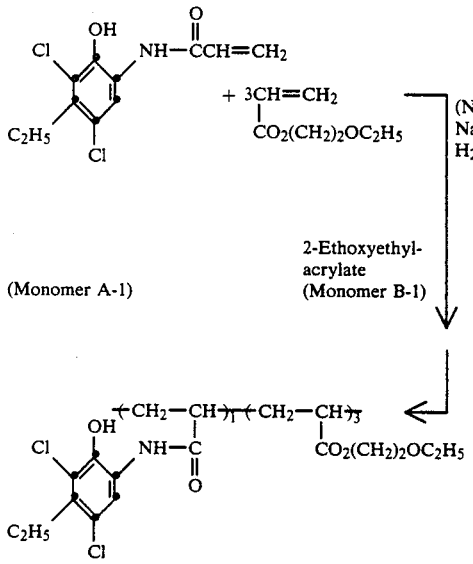

Monomer A-1 (26.01 g, 0.1 mole), Monomer B-1 (43.25 g, 0.3 mole) and sodium bisulfite (0.32 g, 0.003 mole) were added in the order indicated to a stirred mixture of distilled water (450 ml) and sodium dodecylsulfate (2.88 g, 0.01 mole) maintained at 80° C. An ammonium persulfate solution (0.7 g, 0.003 mole, 50 ml distilled water) was added dropwise over a period of 30 minutes to the well-stirred mixture. After the addition was completed, the reaction mixture was stirred for 2 hours at 80° C. A clear latex was obtained. After cooling to room temperature and filtration to remove insoluble material, the latex was dialyzed in a cellulose acetate membrane for two days. After a second filtration and freeze drying of a 50 gram sample to determine the solid content, the composition of the polymer was determined by microanalysis to have a (Monomer A-1):(Monomer B-1) ratio of 1:3.08 for an equivalent weight of 704.01.

Other cyan dye-forming polymeric couplers can be prepared in the same manner.

SYNTHESIS EXAMPLE B

This illustrates the synthesis of cyan dye-forming naphtholic couplers as follows:

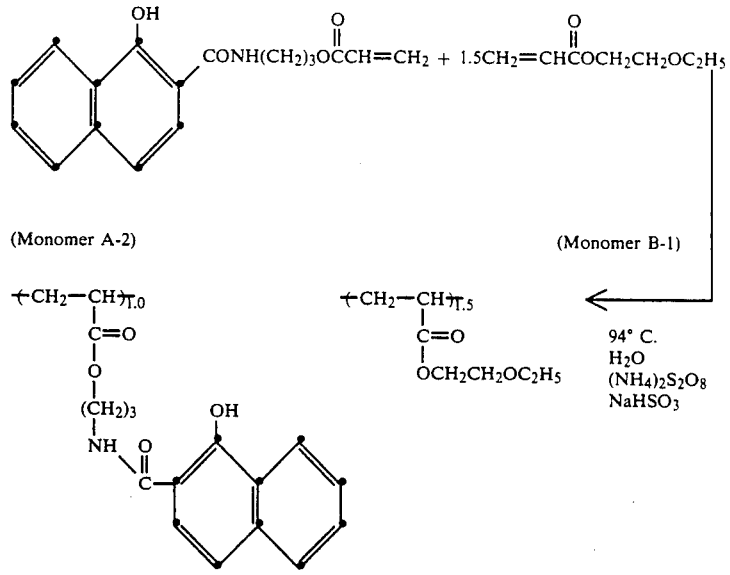

In a 500 ml 3-neck round bottom flask was placed 60 ml, 0.1M solution of sodium dodecyl sulfate, 9.0 ml 0.1M solution of sodium bisulfite. The mixture was stirred and heated to 94° C. A slurry mixture of 8.98 g (0.03 mol) (Monomer A-2) and 6.49 g (0.45 mol) 2-ethoxyethylacrylate (Monomer B-1) (heated to 60° C.) was added slowly to the reaction flask. Simultaneously, a solution of 9.0 ml 0.1M ammonium persulfate was added dropwise over a period of 15 minutes. The reaction mixture was stirred at 94° C. for 2 hours, cooled and filtered. The filtrate was dialyzed in a cellulose membrane for 2 days and filtered again. A sample was freeze dried and microanalyzed to determine a (Monomer A-1):(Monomer B-1) ratio of 1:1.5 for an equivalent weight of 515.58.

SYNTHESIS EXAMPLE C

This illustrates synthesis of magenta dye-forming pyrazolone couplers as follows:

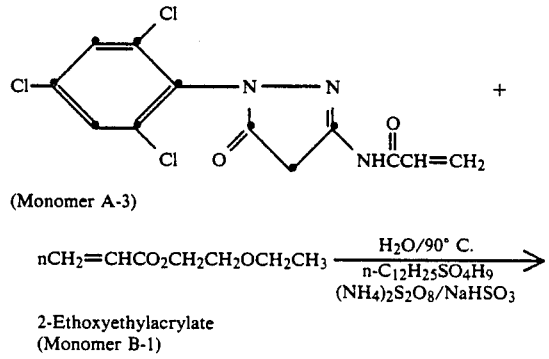

-continued

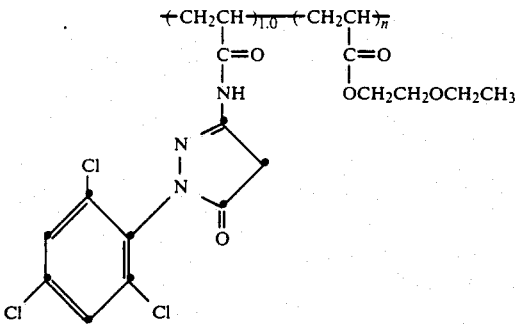

In a 500 ml 3-neck round bottom flask was placed 80 ml nitrogen purged distilled water, 25 ml 0.1M sodium dodecyl sulfate, 6.65 g (0.02 mol) (Monomer A-3) and 2.88 g (0.02 mol) 2-ethoxyethylacrylate (Monomer B-1). The mixture was dispersed using a sonic probe for 30 seconds, then placed in a 90° C. constant temperature water bath. With vigorous stirring under a blanket of nitrogen, a solution of 6 ml of 0.1M $NaHSO_3$ was added in one portion, followed by the dropwise addition of 6 ml of 0.1M $(NH_4)_2S_2O_8$ solution over a period of 15 minutes. The reaction mixture was stirred at 90° C. for 3 hours. After cooling to room temperature, the resulting polymeric latex was filtered and dialyzed in a cellulose acetate membrane for four days. A sample of 25 g was freeze dried to determine the solid content and composition of the polymer. The final polymer latex had an equivalent weight of 472.4.

SYNTHESIS EXAMPLE D

The following terpolymer was prepared as follows:

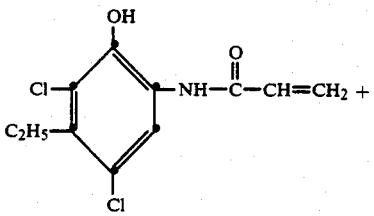

(Monomer A-1)

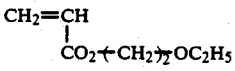

(Monomer B-1)

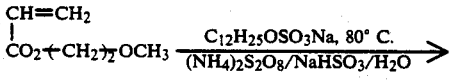

(Monomer B-2)

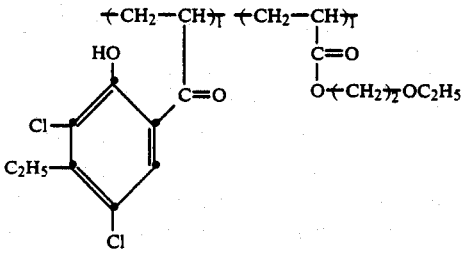

-continued

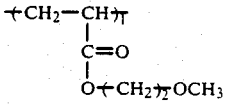

In a 500 mL 3-necked round-bottomed flask was placed 60 mL of an aqueous solution of sodium dodecyl sulfate (0.1M), followed by 60 mL of oxygen-free distilled water. The mixture was maintained at 80° C. Monomer A-1 (7.81 g, 0.03 mole), Monomer B-1 (4.33 g, 0.03 mole), and Monomer B-2 which was 2-methoxyethyl acrylate (3.91 g, 0.03 mole) and 9 mL of an aqueous solution of sodium bisulfite (0.1M) were added in the order indicated to the reaction flask with vigorous stirring. 9 mL of an aqueous solution of ammonium persulfate (0.1M) was added dropwise over a period of 15 minutes to the well-stirred mixture. The reaction mixture was stirred for 2 hours at 80° C. The resulting latex, after cooling, was filtered and dialyzed in a cellulose acetate membrane for 2 days. A sample was freeze-dried and microanalyzed for the solid content and composition of the polymeric coupler. It was found that the polymeric coupler had a (Monomer A-1):(Monomer B-1):(Monomer B-2) ratio of 1:0.92:0.92 with an equivalent weight of 511.06.

SYNTHESIS EXAMPLE E

The following synthesis illustrates preparation of a yellow dye-forming polymeric coupler:

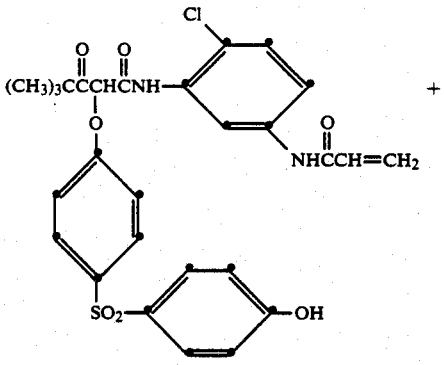

(Monomer A-4)

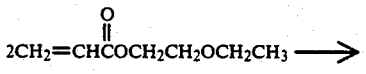

(Monomer B-1)

-continued

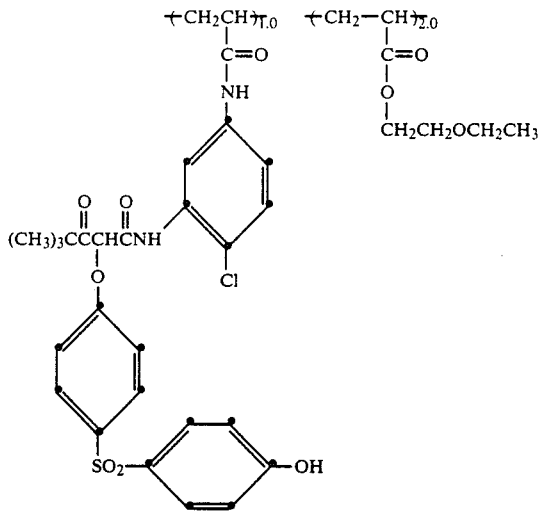

In a 500 ml 3-neck round bottom flask was placed 30 ml nitrogen purged distilled water, 20 ml 0.1M sodium dodecyl sulfate, 5.71 g (0.01 mol) of Monomer A-4 and 2.88 g (0.02 mol) of 2-ethoxyethylacrylate (Monomer B-1). The mixture was thoroughly mixed and dispersed in a blender for 30 seconds, then placed in a 90° C. constant temperature water bath. With stirring, a solution of 6 ml of 0.1M sodium bisulfite was added in one portion, followed immediately by the dropwise addition of 6 ml of 0.1M ammonium persulfate solution. The reaction mixture was stirred at 90° C. for 3 hours. After cooling to room temperature, the resulting polymeric latex was filtered and dialyzed for 3 days. A sample was freeze dried and identified by elemental analysis. The final polymeric latex had an equivalent weight of 909.6.

SYNTHESIS EXAMPLE F

A mixture composed of Monomer A-1 (10.40 g, 0.04 mole), Monomer B-1 (2-ethoxyethyl acrylate, 11.53 g, 0.08 mole) and 108 mL of tetrahydrofuran was heated to 66° C. with stirring while introducing nitrogen. To the solution mixture was added dropwise over a period of 15 minutes a solution of 0.197 g (1.2 mmole) of 2,2'-azobis(2-methylpropionitrile) dissolved in 12 mL of tetrahydrofuran to initiate polymerization. After reacting for 15 hours, the reaction solution was cooled and poured into 1 liter of ligroin. The solid thus obtained was collected and dried under a reduced pressure. 20 g of oleophilic polymeric coupler was obtained. A sample was microanalyzed to determine the composition. It was found that the polymeric coupler had a (Monomer A-1):(Monomer B-1) ratio of 1:1.72 with an equivalent weight of 508.10.

The following examples further illustrate the invention.

EXAMPLES 1-11

A photographic film was prepared by coating the following layers on a poly(ethylene terephthalate) film support:

| |
|---|
| gelatin (1.08 g/m$^2$) |
| (I) bis (vinylsulfonylmethyl) ether (hardener) (0.09 g/m$^2$) |
| gelatin (3.77 g/m$^2$) |

-continued

| |
|---|
| (II) polymeric coupler (1.5 × 10$^{-4}$ mole/m$^2$) |
| (III) polydispersed sulfur and gold sensitized AgBrI (6.5% I) gelatino emulsion |
| Film Support |

The AgBrI gelatino emulsion layer was coated at 0.90 g Ag/m$^2$ for the couplers listed in following Table I-A.

The photographic film was imagewise exposed (3 seconds, 500 W, 2850° K.) and processed in the C-41 process of Eastman Kodak Company, Rochester, N.Y., U.S.A. as described in the British Journal of Photography 1982 Annual, pages 209-211.

The red dye density in the processed photographic element was determined at that point on the sensitometric curve where 0.43 gAg/m$^2$ was developed. The ratio of dye density to developed silver was designated as dye yield. The data in the following Table I indicates that the polymeric couplers in photographic silver halide elements according to the invention provide higher dye yields than photographic silver halide elements containing polymeric couplers prepared from alkylacrylate monomers.

TABLE I

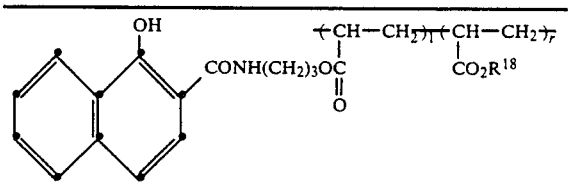

| Example | $R^{18}$ | r | Dye Density Yield | Relative Dye Density Yield |
|---|---|---|---|---|
| Comparative Example A | $C_4H_9$ | 1.78 | 0.014 | 1.00 |
| Comparative Example B | $C_4H_9$ | 4.0 | 0.011 | 0.79 |
| 1 | $-(CH_2)_2OCH_3$ | 1.34 | 0.0405 | 2.89 |
| 2 | $-(CH_2)_2OCH_3$ | 1.60 | 0.0375 | 2.68 |
| 3 | $-(CH_2)_2OCH_3$ | 3.22 | 0.0425 | 3.04 |
| 4 | $-(CH_2)_2OC_2H_5$ | 1.5 | 0.043 | 3.07 |
| 5 | $-(CH_2)_2OC_2H_5$ | 1.76 | 0.042 | 3.00 |
| 6 | $-(CH_2)_2OC_2H_5$ | 3.24 | 0.041 | 2.93 |
| 7 | $-(CH_2)_2OC_4H_9$ | 1.93 | 0.040 | 2.86 |
| 8 | $-(CH_2)_2OC_4H_9$ | 3.85 | 0.036 | 2.57 |
| 9 | $-(CH_2)_2O(CH_2)_2OC_2H_5$ | 0.75 | 0.043 | 3.07 |
| 10 | $-(CH_2)_2O(CH_2)_2OC_2H_5$ | 1.56 | 0.043 | 3.07 |
| 11 | $-(CH_2)_2O(CH_2)_2OC_2H_5$ | 2.03 | 0.042 | 3.00 |

These data indicate that the polymeric couplers of Examples 1-11 provide significantly higher dye yield than the polymeric couplers of Comparative Examples A and B.

EXAMPLES 11-23

The procedure described in Example 1 was repeated with the exception that the polymeric couplers listed in following Table II were used in place of the polymeric coupler of Example 1 and the silver halide emulsion coverage in the layer containing AgBrI was 0.45 g Ag/m$^2$.

The photographic film in the examples listed in Table II were imagewise exposed and processed as described in Example 1.

TABLE II

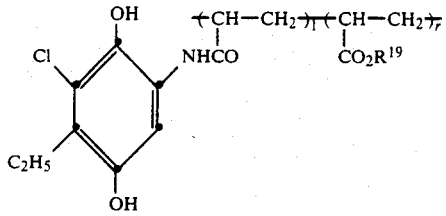

| Example | $R^{19}$ | r | Dye Density Yield | Relative Dye Density Yield |
|---|---|---|---|---|
| Comparative Example C | $C_4H_9$ | 1.11 | .02275 | 1.00 |
| Comparative Example D | $C_4H_9$ | 2.27 | .03000 | 1.32 |
| Comparative Example E | $C_4H_9$ | 3.05 | .03825 | 1.68 |
| Comparative Example F | $C_4H_9$ | 3.95 | .04225 | 1.86 |
| Comparative Example G | $CH_3$ | 2.75 | .0435 | 1.91 |
| Comparative Example H | $C_4H_9$ | 3.05 | .03825 | 1.68 |
| Comparative Example I | $C_6H_{13}$ | 3.09 | .0375 | 1.65 |
| Comparative Example J | $-CH_2CH(C_2H_5)C_4H_9$ | 2.67 | .0360 | 1.58 |
| Example 12 | $-(CH_2)_2OC_2H_5$ | 1.13 | .0385 | 1.69 |
| Example 13 | $-(CH_2)_2OC_2H_5$ | 2.12 | .0525 | 2.31 |
| Example 14 | $-(CH_2)_2OC_2H_5$ | 2.64 | .0575 | 2.52 |
| Example 15 | $-(CH_2)_2OC_2H_5$ | 3.52 | .0655 | 2.88 |
| Example 16 | $-(CH_2)_2OCH_3$ | 1.05 | .0365 | 1.60 |
| Example 17 | $-(CH_2)_2OCH_3$ | 2.87 | .0660 | 2.90 |
| Example 18 | $-(CH_2)_2OC_4H_9$ | 1.03 | .0310 | 1.36 |
| Example 19 | $-(CH_2)_2OC_4H_9$ | 3.00 | .0540 | 2.37 |
| Example 20 | $-(CH_2)_2O(CH_2)_2OC_2H_5$ | 0.95 | .0435 | 1.95 |
| Example 21 | $-(CH_2)_2O(CH_2)_2OC_2H_5$ | 2.83 | .0590 | 2.59 |

Comparison of the polymeric couplers with similar r values indicates that the polymeric couplers of the invention provide a significant increase in dye yield. For instance, comparison of the dye yield of Examples 15 and 19 shows significantly higher dye yield compared to the results of Comparative Examples F, H and I. Comparison of the dye yield of Examples 13, 14, 17 and 21 shows significantly higher dye yield compared to the results of Comparative Examples G and J.

EXAMPLES 24–25

The procedure described in Example 1 was repeated with the exception that the polymeric couplers listed in following Table III were used in place of the polymeric coupler of Example 1 and the silver halide emulsion coverage in the layer containing AgBrI was 0.90 g $Ag/m^2$.

The photographic film in the examples listed in Table III were imagewise exposed and processed as described in Example 1.

Also, rather than determine the dye density yield at a single point on the sensitometric curve, a plot of dye density versus developed silver ranging from 0.11 to 0.43 $g/m^2$ was made and the dye density yield was represented as the slope of the resulting line.

TABLE III

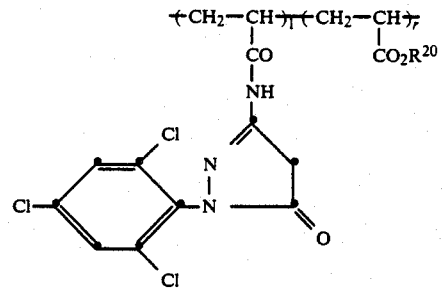

| Example | $R^{20}$ | r | Dye Density Yield | Relative Dye Density Yield |
|---|---|---|---|---|
| Comparative Example K | $-C_4H_9$ | 0.94 | 0.0325 | 1.00 |
| Example 24 | $(CH_2)_2OC_2H_5$ | 1.04 | 0.036 | 1.13 |
| Comparative Example L | $-C_4H_9$ | 1.68 | 0.038 | 1.19 |
| Example 25 | $(CH_2)_2OC_2H_5$ | 2.17 | 0.043 | 1.34 |

Comparison of the results of Example 24 with the results of Comparative Example K having comparable r values indicates that the polymeric coupler of Example 24 provides significantly higher dye density yield. Comparison of the results of Example 25 with the results of Comparative Example L having comparable r values indicates that the polymeric coupler of Example 25 provides significantly higher dye density yield.

EXAMPLES 26–27

The procedure described in Example 1 was repeated with the exception that the polymeric couplers listed in following Table IV were used in place of the polymeric coupler of Example 1 and the silver halide emulsion coverage in the layer containing AgBrI was 90 g $Ag/m^2$.

The photographic film in each of the examples listed in Table IV were imagewise exposed and processed as described in Example 1.

Also, rather than determine the dye density yield at a single point on the sensitometric curve, a plot of dye density versus developed silver ranging from 0.05 to 0.43 $g/m^2$ was made and the dye density yield was represented as the slope of the resulting line.

TABLE IV

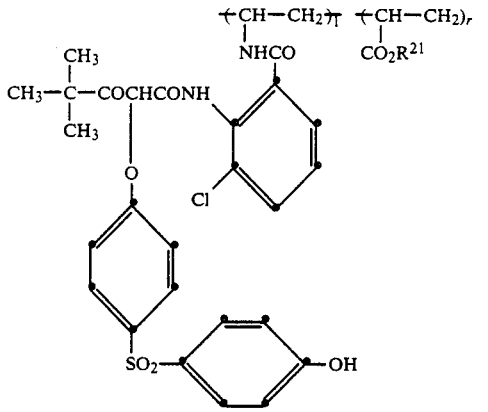

| Example | $R^{21}$ | r | Dye Density Yield | Relative Dye Density Yield |
|---|---|---|---|---|
| Comparative Example M | $-CH_3$ | 1.46 | .008 | 1.00 |
| Comparative Example N | $-C_2H_5$ | 2.32 | .008 | 1.00 |
| Comparative Example O | -n-$C_4H_9$— | 2.40 | .013 | 1.63 |
| Comparative Example P | -n-$C_6H_{13}$— | 2.21 | .012 | 1.50 |
| Example 26 | $-(CH_2)_2OCH_3$ | 2.81 | .041 | 5.12 |
| Example 27 | $-(CH_2)_2OC_2H_5$ | 2.35 | .035 | 4.38 |

This table shows that the polymeric couplers of Examples 26 and 27 provide significantly higher dye density yield than the polymeric couplers of Comparative Examples M, N, O and P.

EXAMPLES 28-32

The procedure described in Example 1 was repeated with the exception that the polymeric couplers listed in following Table V were used in place of the polymeric coupler of Example 1 and the silver halide emulsion coverage in the layer containing AgBrI was 0.90 g $Ag/m^2$.

The photographic films in each of the examples listed in Table V were imagewise exposed and processed as described in Example 1.

Also, rather than determine the dye density yield at a single point on the sensitometric curve, a plot of dye density versus developed silver ranging from 0.05 to 0.43 $g/m^2$ was made and the dye density yield was represented as the slope of the resulting line.

TABLE V

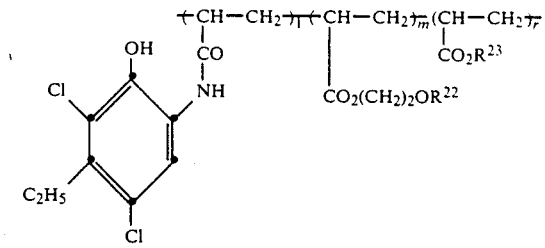

| Example | $R^{22}$ | $R^{23}$ | l:m:r | Dye Density Yield | Relative Dye Density Yield |
|---|---|---|---|---|---|
| 28 | $C_2H_5$ | $nC_6H_{13}$ | 1:0.90:0.90 | 0.022 | 1.00 |
| 29 | $C_2H_5$ | $nC_4H_9$ | 1:1.0:1.0 | 0.043 | 1.95 |
| 30 | $C_2H_5$ | $-(CH_2)_2OCH_3$ | 1:0.92:0.92 | 0.052 | 2.36 |
| 31 | $CH_3$ | $nC_4H_9$ | 1:1.0:1.0 | 0.035 | 1.59 |
| 32 | $CH_3$ | $(CH_2)_2OC_2H_5$ | 1:0.92:0.92 | 0.052 | 2.36 |

The invention has been described in detail with particular reference to preferred embodiments thereof, but it will be understood that variations and modifications can be effected within the spirit and scope of the invention.

What is claimed is:

1. A photographic element comprising a support, at least one photographic silver halide emulsion layer and a polymeric coupler which is at least a copolymer comprising a repeating unit comprising a coupler moiety and at least one repeating unit derived from a monomer which is an alkoxyalkylacrylate containing no coupler moiety wherein the alkoxyalkyl moiety is unsubstituted.

2. A photographic element as in claim 1 wherein the alkoxyalkylacrylate monomer is represented by the formula:

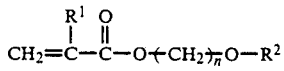

wherein:

$R^1$ is hydrogen, methyl or chlorine;

$R^2$ is unsubstituted alkyl, or $-R^3-O-R^4$;

n is 1 to 10;

$R^3$ is alkylene;

$R^4$ is unsubstituted alkyl.

3. A photographic element as in claim 2 wherein alkyl in $R^2$ contains 1 to 4 carbon atoms, $R^3$ is alkylene containing 1 to 8 carbon atoms and $R^4$ is alkyl containing 1 to 10 carbon atoms.

4. A photographic element as in claim 1 wherein the monomer which is an alkoxyalkylacrylate is a compound selected from the group consisting of:

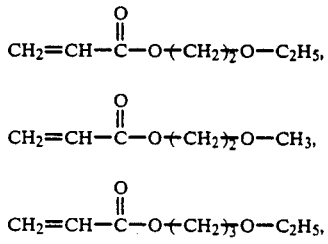

-continued $$CH_2{=}CH{-}\overset{O}{\overset{\|}{C}}{-}O{+}CH_2{+}_3O{-}CH_3,\text{ and}$$

combinations thereof.

5. A photographic element as in claim 1 which comprises at least one blue-sensitive photographic silver halide emulsion layer containing at least one yellow image dye-forming coupler; at least one green-sensitive photographic silver halide emulsion layer containing at least one magenta image dye-forming coupler; and at least one red-sensitive photographic silver halide emulsion layer containing at least one cyan image dye-forming coupler and wherein at least one of the image-dye forming couplers is a polymeric coupler.

6. A photographic element as in claim 1 wherein the polymeric coupler is a polymer latex.

7. A photographic element as in claim 1 wherein the polymeric coupler is a terpolymer comprising at least one repeating unit derived from a monomer selected from the group consisting of acrylic acid,
acrylic acid esters,
acrylic acid amides,
vinyl esters,
acrylonitrile,
aromatic vinyl compounds,
vinylidene chloride,
itaconic acid,
itaconic acid monomers,
citraconic acid,
crotonic acid,
maleic acid esters,
N-vinyl-2-pyrrolidone,
N-vinyl pyridine,
vinyl alkyl ethers,
methacrylic acid,
β-carboethylacrylate and its metal salts,
β-sulfoethylacrylate and its metal salts, and
2-acrylamido-2-methyl propane sulfonic acid and its metal salts.

8. A photographic element as in claim 1 wherein the polymeric coupler is a magenta dye-forming polymeric coupler latex.

9. A photographic element comprising a support, at least one photographic silver halide emulsion layer and a polymeric coupler which comprises a repeating unit (A) that comprises at least one coupler moiety and a repeating unit (B) that is represented by the formula:

$$CH_2{=}\overset{R_1}{\overset{|}{C}}{-}\overset{O}{\overset{\|}{C}}{-}O{+}CH_2{+}_nO{-}R_2$$

wherein:

$R_1$ is hydrogen, methyl or chlorine;
$R_2$ is unsubstituted alkyl, or $-R_3-O-R_4$;
n is 1 to 10;
$R_3$ is alkylene;
$R_4$ is unsubstituted alkyl.

10. A photographic element comprising a support, at least one photographic silver halide emulsion layer and a polymeric dye-forming coupler represented by the formula:

$$\begin{array}{c} R^5 \\ | \\ {+}CH_2{-}C{+}_x \\ | \\ (L) \\ | \\ (COUP) \end{array} \qquad \begin{array}{c} R^1 \\ | \\ {+}CH_2{-}C{+}_y \\ | \\ C{=}O \\ | \\ O{+}CH_2{+}_nO{-}R^2 \end{array}$$

wherein:

COUP is a dye-forming coupler moiety capable of reacting with oxidized color developing agent;
$R^1$ and $R^5$ are individually hydrogen, methyl or chlorine;
$R^2$ is unsubstituted alkyl, or $-R_3-O-R_4$;
$R_3$ is alkylene;
$R_4$ is unsubstituted alkyl;
x is 1 to 10;
y is 1 to 10;
L is a linking group; and
n is 1 to 10.

11. A photographic element as in claim 10 wherein COUP is a cyan dye-forming coupler moiety.

12. A photographic element as in claim 10 wherein COUP is a magenta dye-forming coupler moiety.

13. A photographic element as in claim 10 wherein COUP is a yellow dye-forming coupler moiety.

14. A photographic element as in claim 10 wherein COUP is a coupler moiety capable of releasing a photographically useful group upon processing.

15. A process of forming a photographic image which comprises developing an exposed silver halide emulsion layer with a color developing agent in the presence of a polymeric coupler wherein the polymeric coupler is at least a copolymer comprising a repeating unit comprising a coupler moiety and at least one repeating unit derived from a monomer which is an alkoxyalkylacrylate containing no coupler moiety wherein the alkoxyalkyl moiety is unsubstituted.

16. A process as in claim 15 wherein the monomer which is an alkoxyalkylacrylate monomer is represented by the formula:

$$CH_2{=}\overset{R^1}{\overset{|}{C}}{-}\overset{O}{\overset{\|}{C}}{-}O{+}CH_2{+}_nO{-}R^2$$

wherein:

$R^1$ is hydrogen, methyl or chlorine;
$R^2$ is unsubstituted alkyl, or $-R^3-O-R^4$;
n is 1 to 10;
$R^3$ is alkylene;
$R^4$ is unsubstituted alkyl.

17. A process as in claim 15 wherein the monomer which is an alkoxyalkylacrylate is a compound selected from the group consisting of:

$$CH_2{=}CH{-}\overset{O}{\overset{\|}{C}}{-}O{+}CH_2{+}_2O{-}C_2H_5,$$

$$CH_2{=}CH{-}\overset{O}{\overset{\|}{C}}{-}O{+}CH_2{+}_2O{-}CH_3,$$

$$CH_2{=}CH{-}\overset{O}{\overset{\|}{C}}{-}O{+}CH_2{+}_3O{-}C_2H_5,$$

-continued $$CH_2{=}CH{-}\overset{O}{\overset{\|}{C}}{-}O{+}CH_2{+}_3O{-}CH_3,\ \text{and}$$

combinations thereof.

18. A photographic element comprising a support, at least one photographic silver halide emulsion layer and a polymeric coupler which comprises a repeating unit (A) that comprises at least one coupler moiety and a repeating unit (B) that is derived from a monomer that is an alkoxyalkylacrylate wherein the alkoxyalkyl moiety is unsubstituted; and wherein only the repeating (A) comprises a coupler moiety.

19. A photographic element as in claim 18 wherein the repeating unit (B) is derived from a monomer that is a compound selected from the group consisting of:

$$CH_2{=}CH{-}\overset{O}{\overset{\|}{C}}{-}O{+}CH_2{+}_2O{-}C_2H_5,$$

$$CH_2{=}CH{-}\overset{O}{\overset{\|}{C}}{-}O{+}CH_2{+}_2O{-}CH_3,$$

$$CH_2{=}CH{-}\overset{O}{\overset{\|}{C}}{-}O{+}CH_2{+}_3O{-}C_2H_5,$$

$$CH_2{=}CH{-}\overset{O}{\overset{\|}{C}}{-}O{+}CH_2{+}_3O{-}CH_3,\ \text{and}$$

combinations thereof.

20. A photographic element as in claim 18 wherein the polymeric coupler is a terpolymer and comprises a repeating unit (C) derived from a monomer selected from the group consisting of acrylic acid,
acrylic acid esters,
acrylic acid amides,
vinyl esters,
acrylonitrile,
aromatic vinyl compounds,
vinylidene chloride,
itaconic acid,
itaconic acid monoesters,
citraconic acid,
crotonic acid,
maleic acid esters,
N-vinyl-2-pyrrolidone,
N-vinyl pyridine,
vinyl alkyl ethers,
methacrylic acid,
β-carboethylacrylate and its metal salts,
β-sulfoethylacrylate and its metal salts, and
2-acrylamido-2-methyl propane sulfonic acid and its metal salts.

21. A photographic element comprising a support, at least one photographic silver halide emulsion layer and a polymeric coupler which comprises a repeating unit derived from a monomer which is an alkoxyalkylacrylate is a compound selected from the group consisting of:

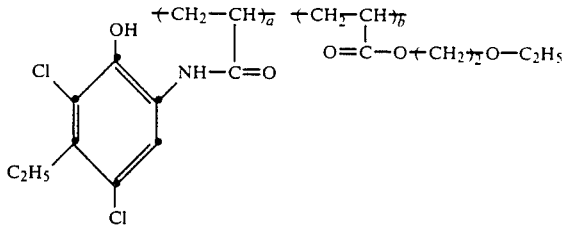

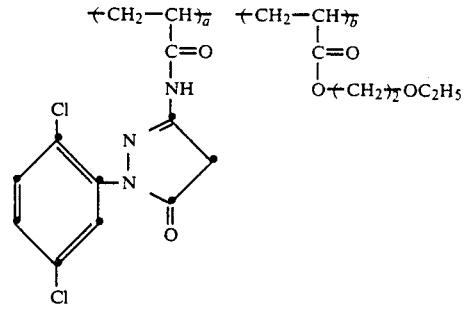

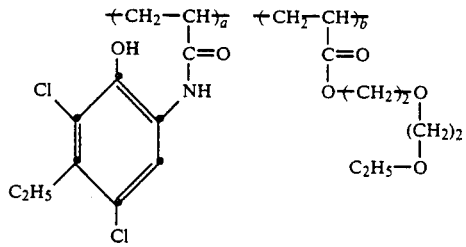

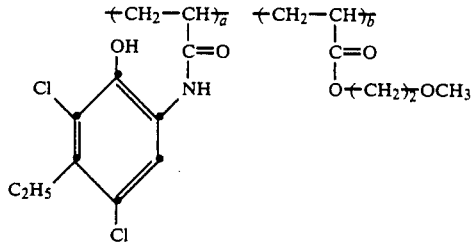

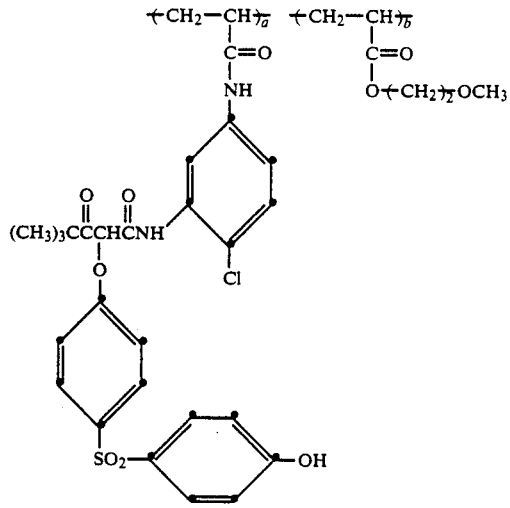

and

-continued

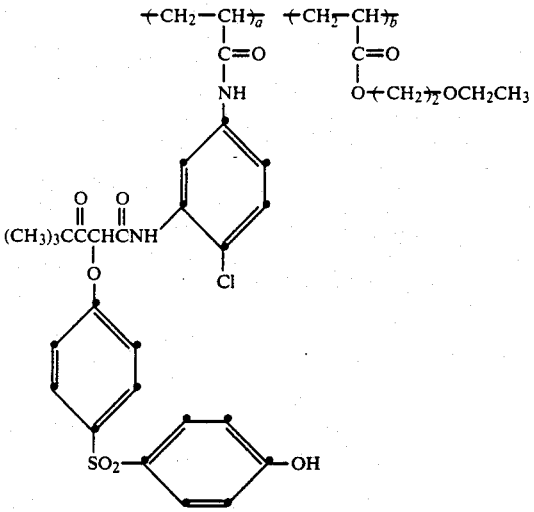

wherein:

a is 1 to 10; and b is 1 to 10.

22. A process of forming a photographic image which comprises developing an exposed silver halide emulsion layer with a color developing agent in the presence of a polymeric coupler which comprises a repeating unit (A) that comprises at least one coupler moiety and a repeating unit (B) that is derived from a monomer that is an alkoxyalkylacrylate wherein the alkoxyalkyl moiety is unsubstituted, wherein only the repeating (A) comprises a coupler moiety.

23. A process of forming a photographic image which comprises developing an exposed silver halide emulsion layer with a color developing agent in the presence of a polymeric coupler which is a compound selected from the group consisting of:

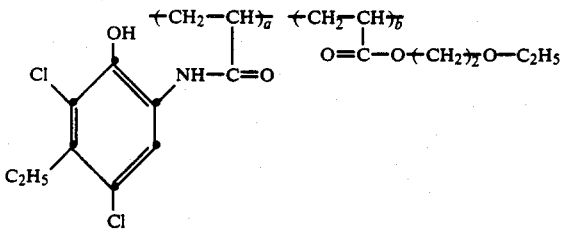

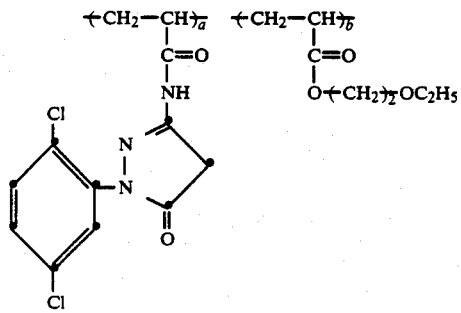

-continued

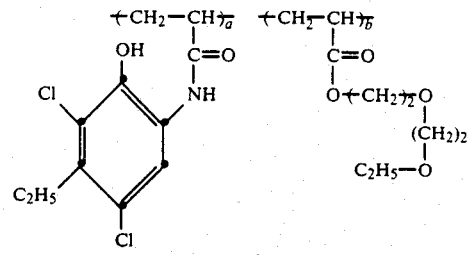

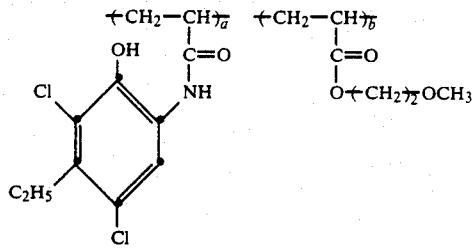

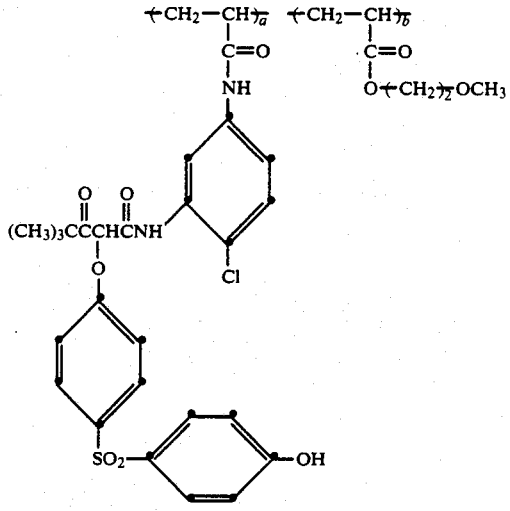

and

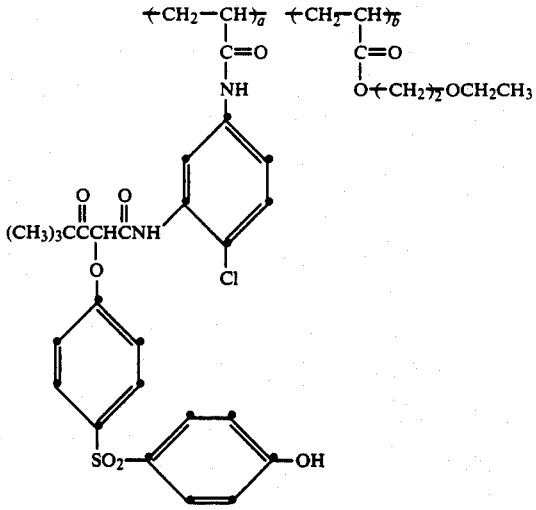

wherein:

a is 1 to 10; and b is 1 to 10.

* * * * *